United States Patent [19]

Anderson et al.

[11] Patent Number: 4,691,496

[45] Date of Patent: Sep. 8, 1987

[54] FILLER LINE MONITORING SYSTEM

[75] Inventors: F. Allan Anderson, San Francisco; Henry C. J. Chen, Fremont; Vito A. DiMucci, Saratoga; Roger C. Wang, San Jose, all of Calif.

[73] Assignee: Peco Controls Corporation, Milpitas, Calif.

[21] Appl. No.: 462,640

[22] Filed: Jan. 31, 1983

[51] Int. Cl.[4] ..... B65B 57/00

[52] U.S. Cl. ..... 53/53; 53/64; 53/282; 53/500; 141/83; 141/95; 141/144

[58] Field of Search ..... 53/52, 53, 54, 266 R, 53/282, 493, 272, 500, 64; 141/83, 94, 95, 96, 140, 144; 364/468, 469, 478; 340/825.16; 378/52, 57; 250/357.1

[56] References Cited

U.S. PATENT DOCUMENTS

| | | | |
|---|---|---|---|
| 3,368,593 | 2/1968 | Mamas | 141/83 |
| 3,477,197 | 11/1969 | Budz | 53/53 |
| 3,818,232 | 6/1974 | Kirkpatrick | 250/357.1 |
| 3,828,668 | 8/1974 | Zugcic | 198/340 |
| 4,038,805 | 8/1977 | Holladay et al. | 53/53 |
| 4,172,347 | 10/1979 | Nitz | 53/52 |
| 4,337,608 | 7/1982 | Schlosser et al. | 53/282 |
| 4,390,782 | 6/1983 | Vornfett | 250/223 B |
| 4,408,295 | 10/1983 | Kavage et al. | 364/478 |
| 4,441,302 | 4/1984 | Gabbitas et al. | 53/52 |

OTHER PUBLICATIONS

"The New Generation of Filler Line Monitoring", Published By Heuft GmbH.

"Fill Level Detectors Bottle Sorters Crate Checkers Data Control Systems", Published by Heuft GmbH, 1980.

*Primary Examiner*—John Sipos

*Attorney, Agent, or Firm*—Thomas S. MacDonald; Alan H. MacPherson; Steven F. Caserza

[57] ABSTRACT

A monitoring and control system for a fluid container filler line having an empty container in-feed conveyor (11), a multivalve fill station (14), a multihead scanner station (17), a discharge conveyor (20) and a fill height detector (25), the system comprising a sensing module (22) having a first sensor (44) to indicate the first of a sequence of numbered valves with means to reset a valve counter, a second sensor (45) to count each valve of the sequence and controller means (50) responsive to said sensors to spacially track each container (12) through the system and to identify the particular fill valve for each particular container. A detector (54) is responsive to the controller and signals from the height detector to detect an improperly filled faulty container and identify the particular number valve which did the faulty filling. The invention also includes detection of faulty seamer operation, means to automatically sample containers for test purposes and means to prevent an incoming container from taking a position to be filled by a faulty valve. Means are also included to analyze the flow of containers and the quality of filling and predict line fill losses attributable to faulty valves which information is used to decide if a faulty valve shall be rendered inoperative.

20 Claims, 20 Drawing Figures

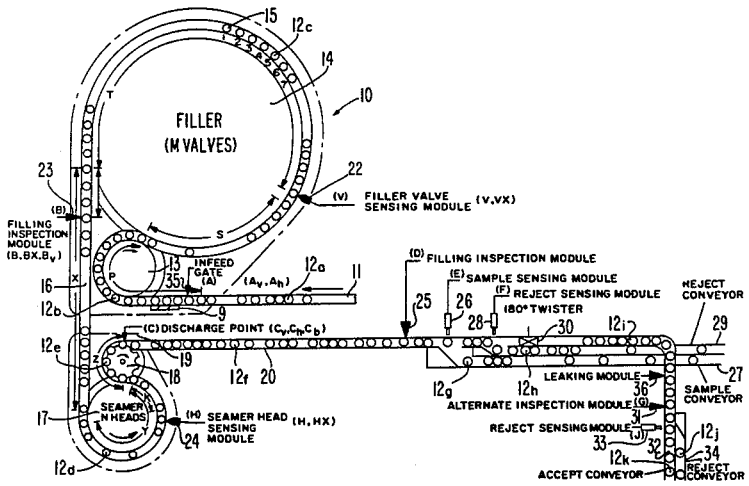

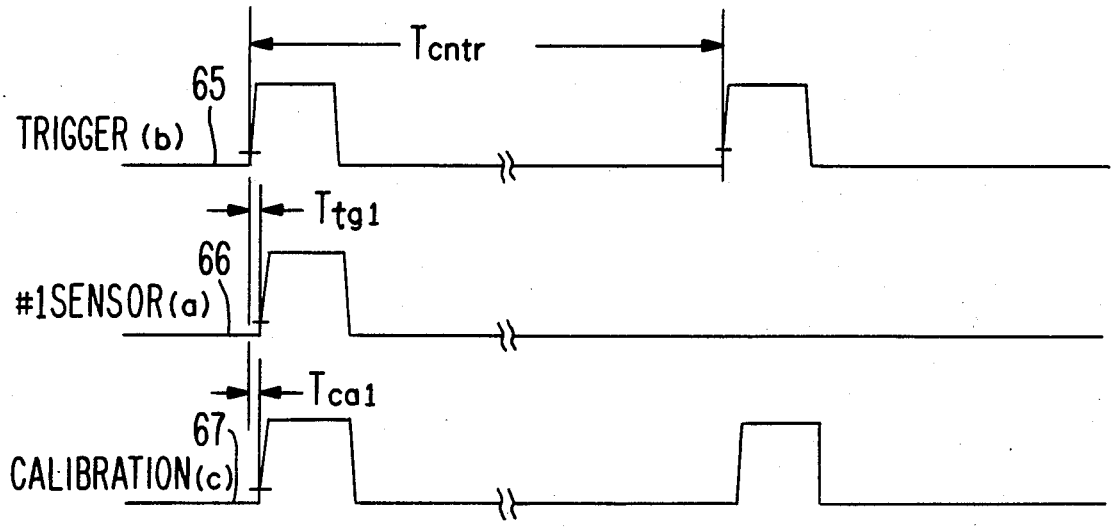
| PARAMETERS | TIME MIN | MAX | UNIT |
|---|---|---|---|
| Tcntr | 25 | | ms |
| Ttg1 | 0 | Tcntr | |
| Tca1 | 0 | Tcntr | |
FIG. 3 SENSOR TIMING
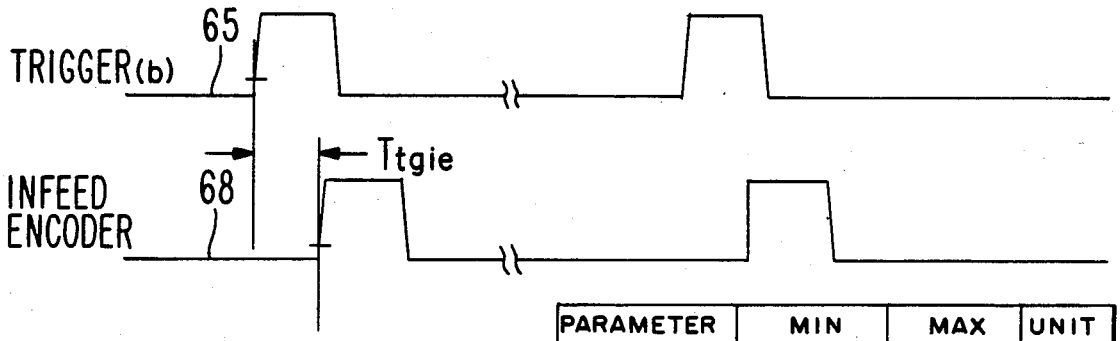
| PARAMETER | MIN | MAX | UNIT |
|---|---|---|---|
| Ttgie | 1.0 | Tcntr | ms |
FIG. 5 TIMING BETWEEN VALVE COUNTER TRIGGER AND INFEED ENCODER

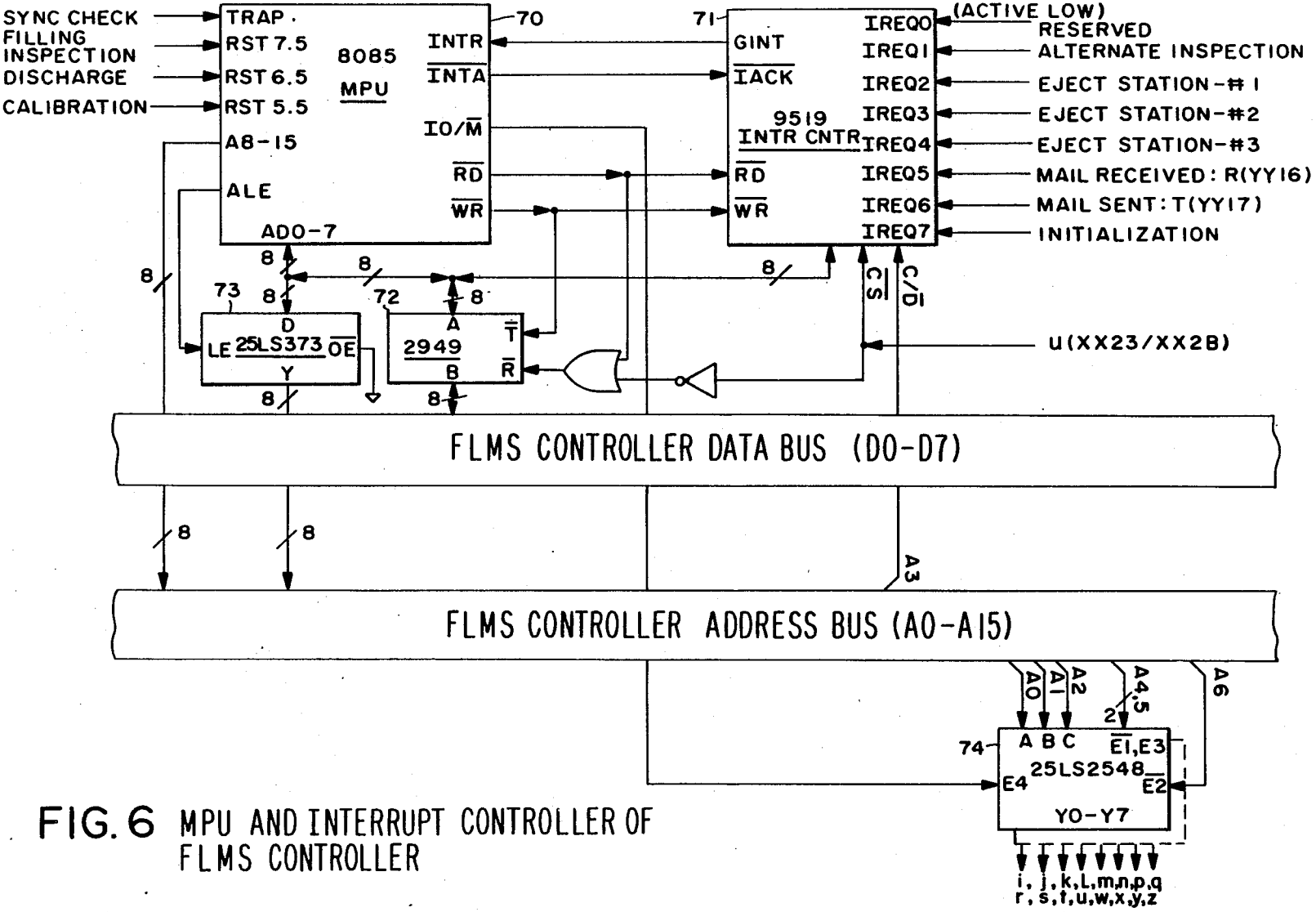
FIG. 6 MPU AND INTERRUPT CONTROLLER OF FLMS CONTROLLER

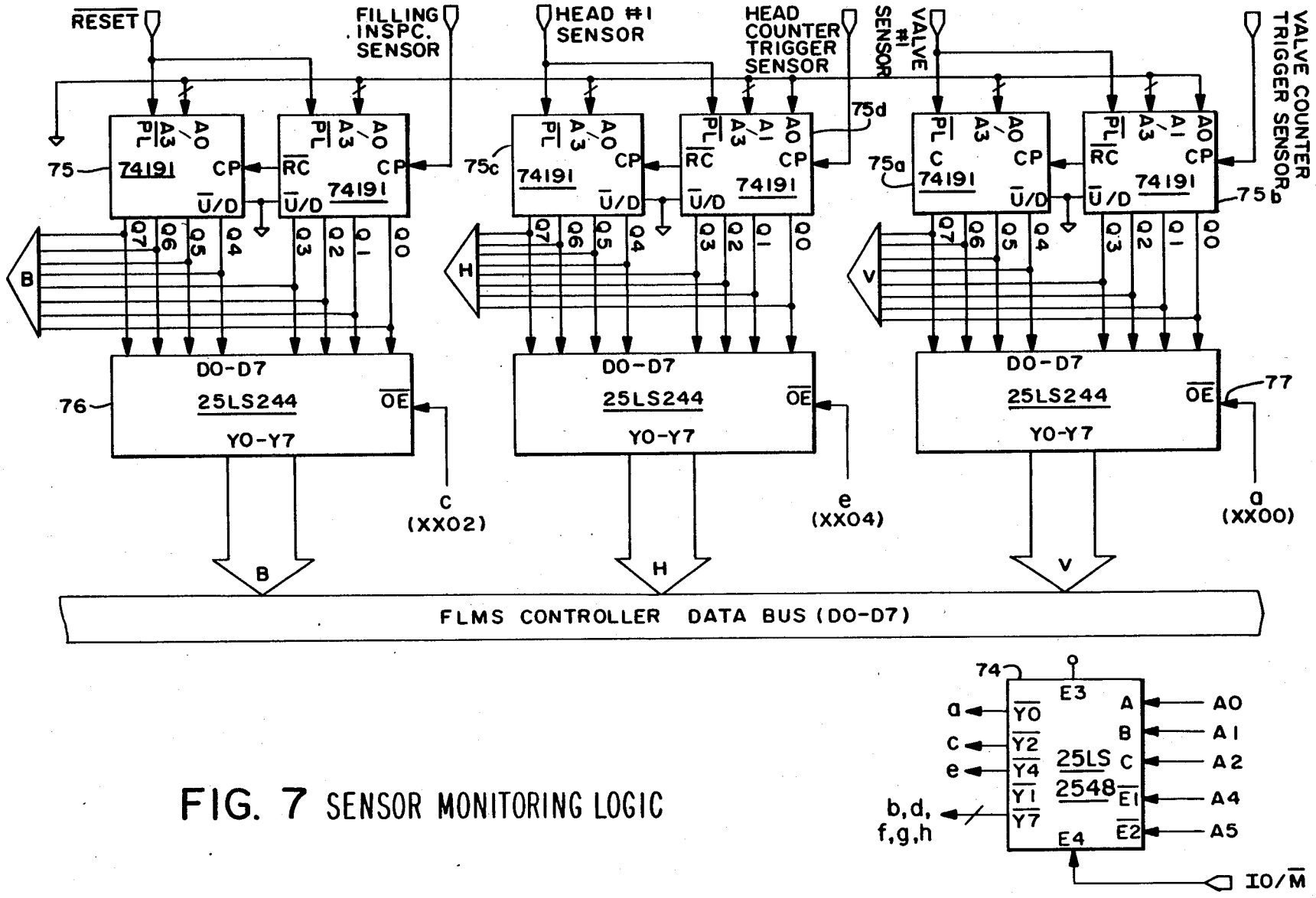
FIG. 7 SENSOR MONITORING LOGIC

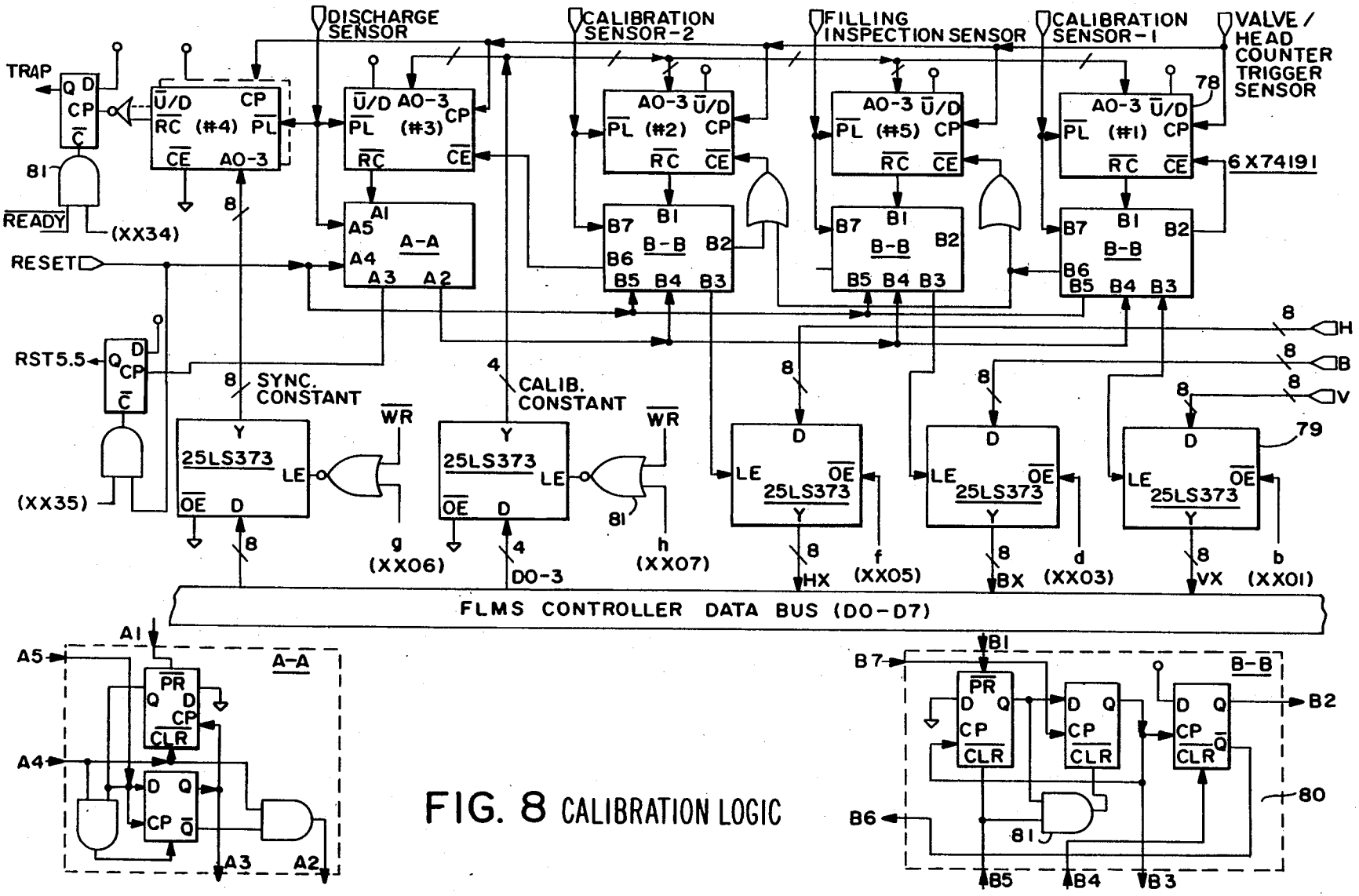
VALVE / HEAD COUNTER TRIGGER SENSOR
CALIBRATION SENSOR-1
FILLING INSPECTION SENSOR
CALIBRATION SENSOR-2
DISCHARGE SENSOR
6X74191
AO-3 U/D CP (#1) PL RC CE
B-B
AO-3 U/D CP (#5) PL RC CE
AO-3 U/D CP (#2) PL RC CE
AO-3 CP (#3) U/D PL RC CE
A-A
U/D CP (#4) RC PL AO-3 CE
25LS373
CALIB. CONSTANT
SYNC. CONSTANT
FLMS CONTROLLER DATA BUS (DO-D7)
TRAP
READY
RESET
RST5.5
(XX34)
(XX35)
(XX01)
(XX03)
(XX05)
(XX07)
(XX06)
FIG. 8 CALIBRATION LOGIC

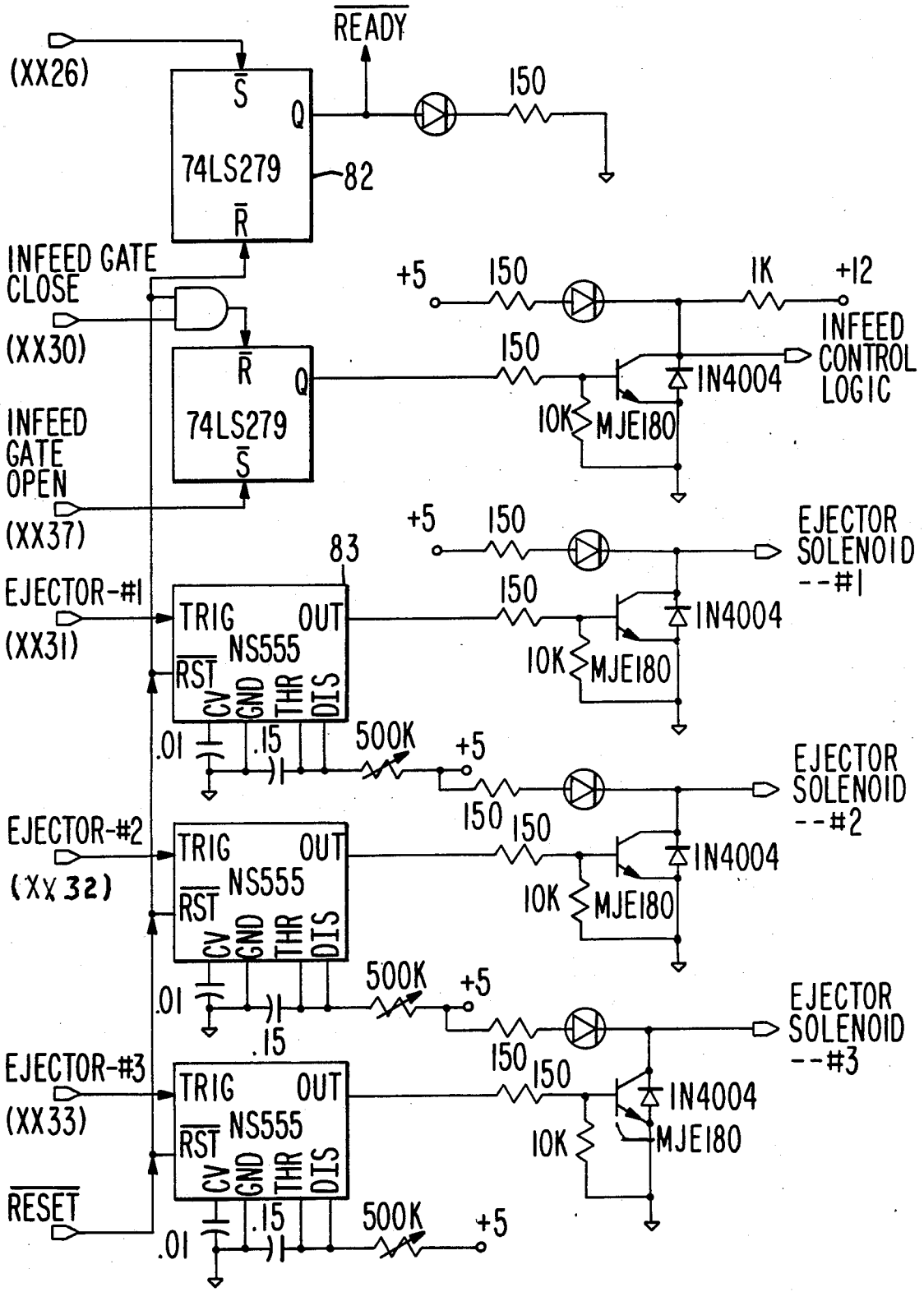
FIG. 9 CONTROL LOGIC

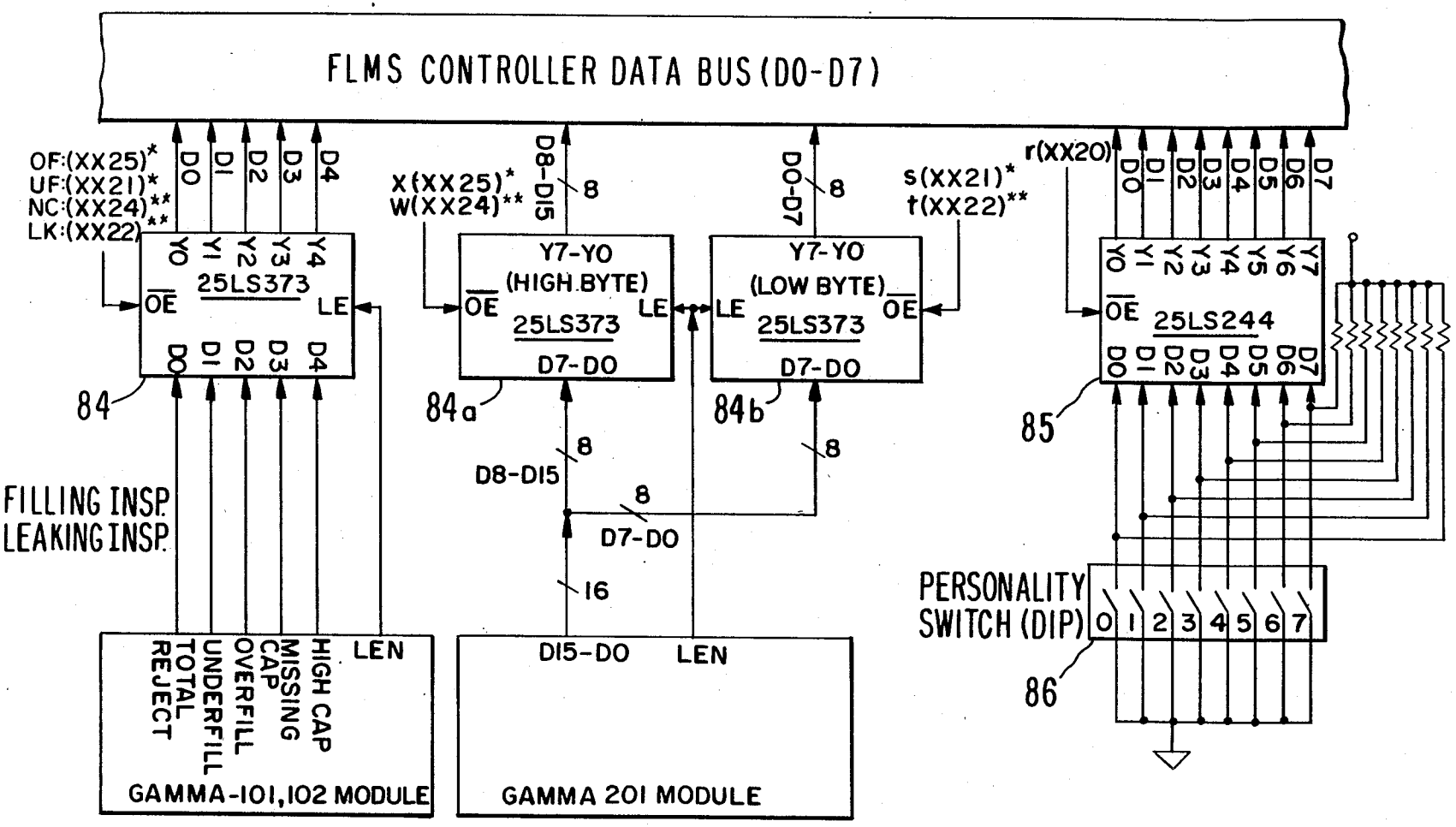
FIG. 10 INSPECTION INPUT INTERFACE LOGIC AND PERSONALITY SWITCH

MEMORY OF FLMS CONTROLLER

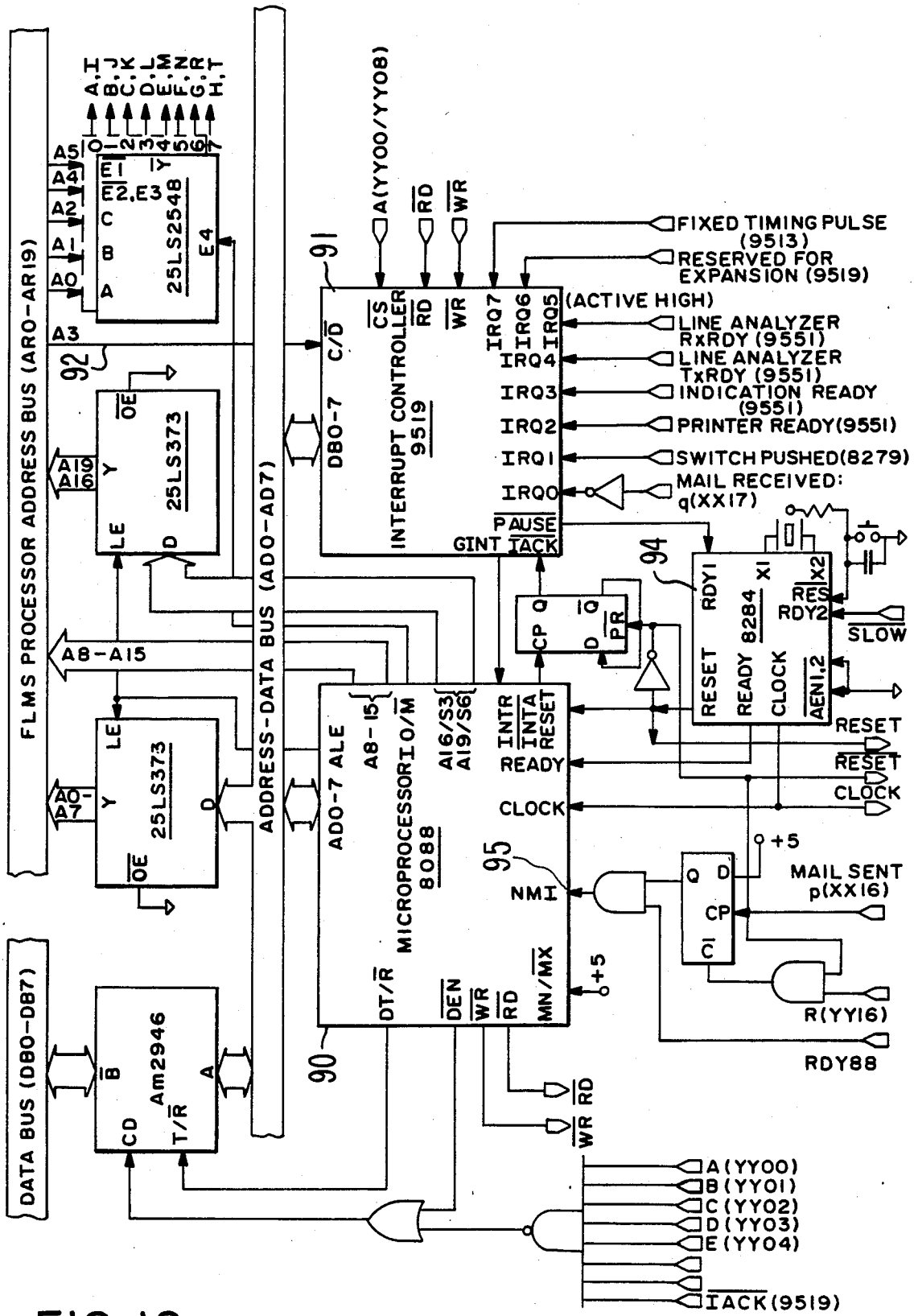
FIG. 12 FLMS PROCESSOR MPU AND INTERRUPT CONTROLLER

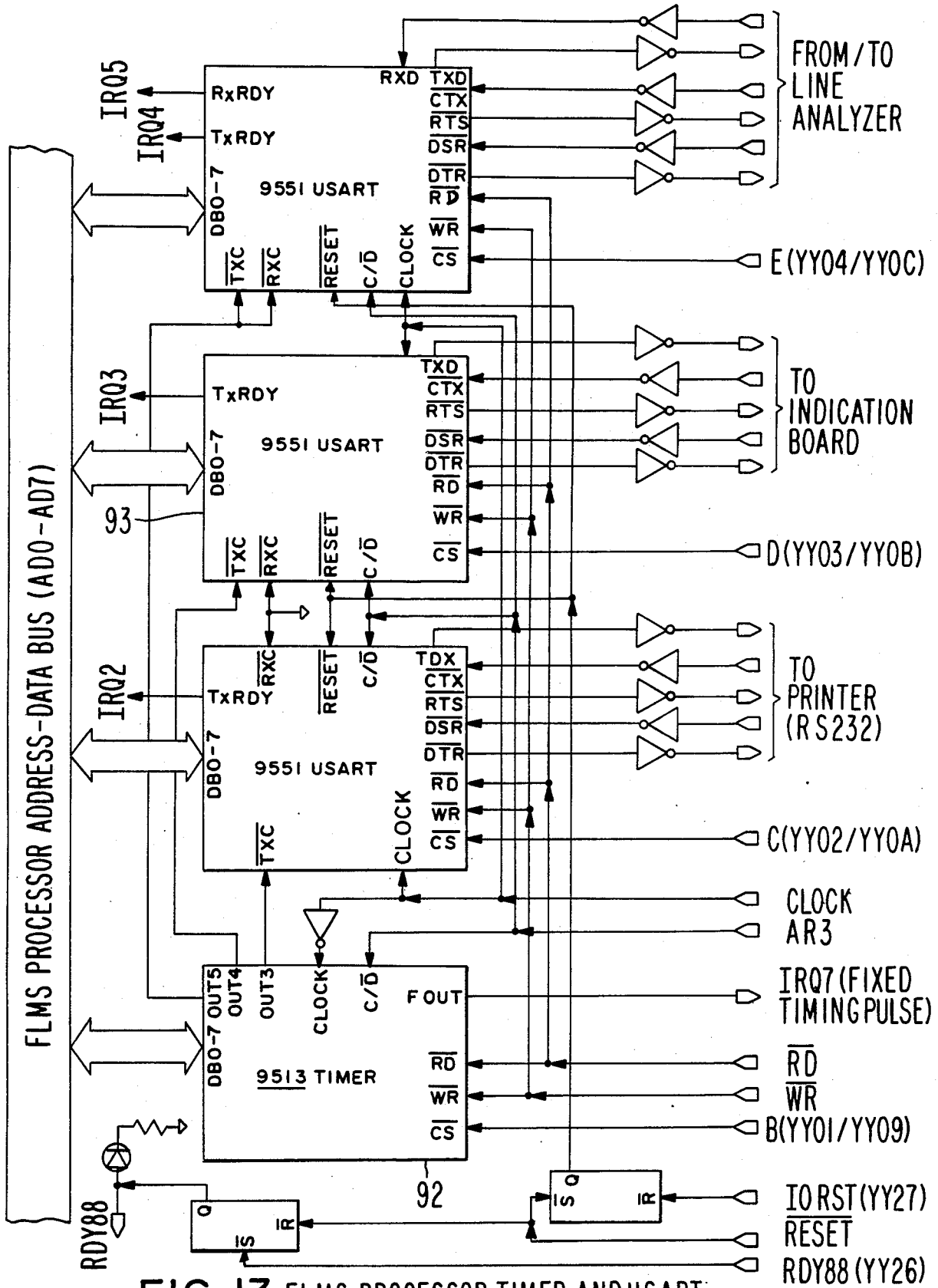
FIG. 13 FLMS PROCESSOR TIMER AND USARTs

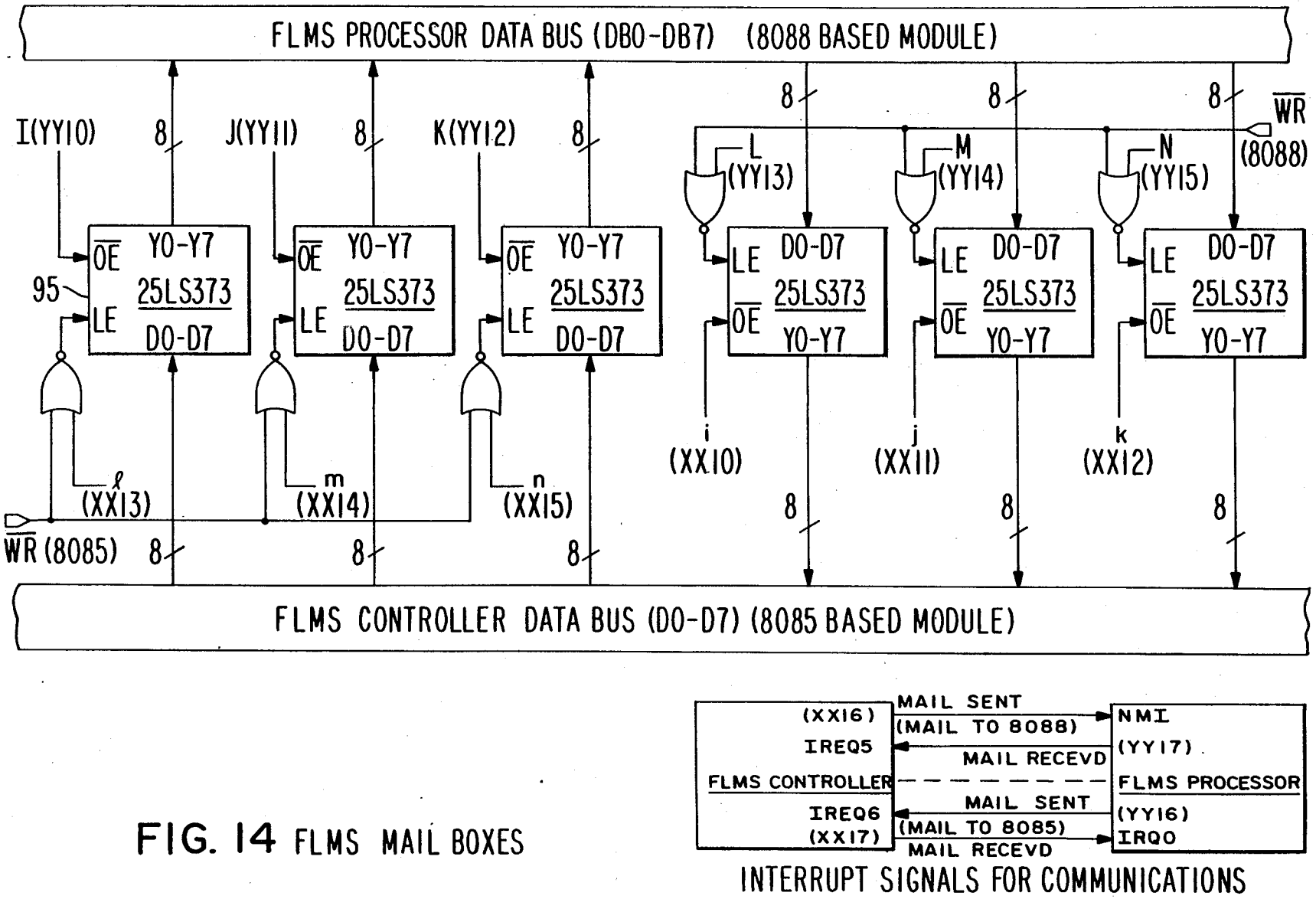
FIG. 14 FLMS MAIL BOXES

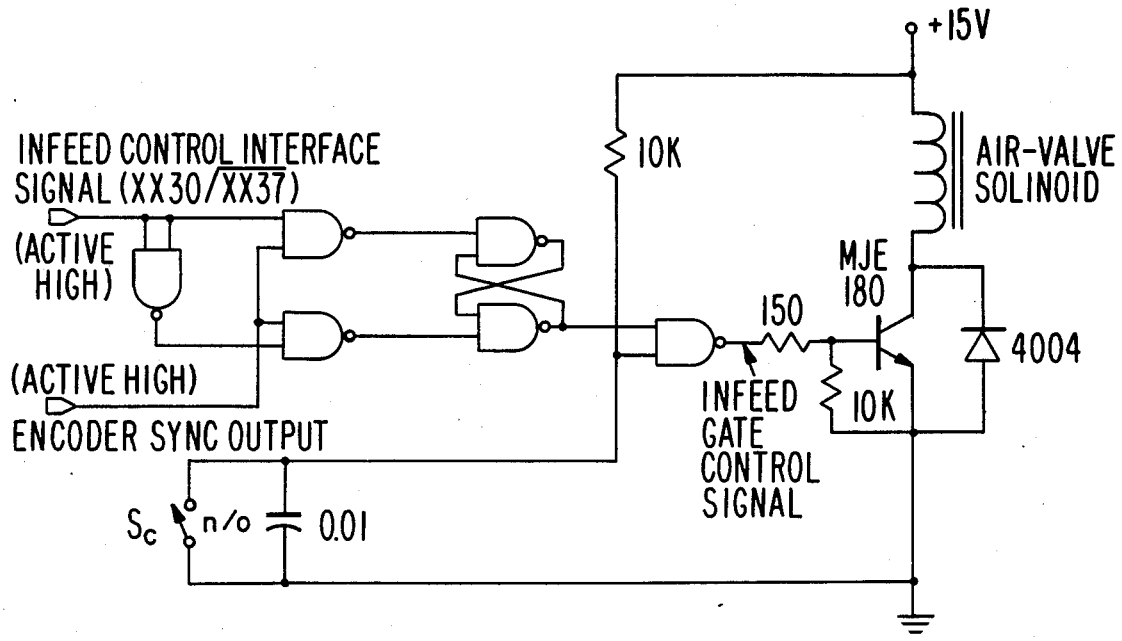
FIG. 15 INFEED CONTROL INTEFACE LOGIC
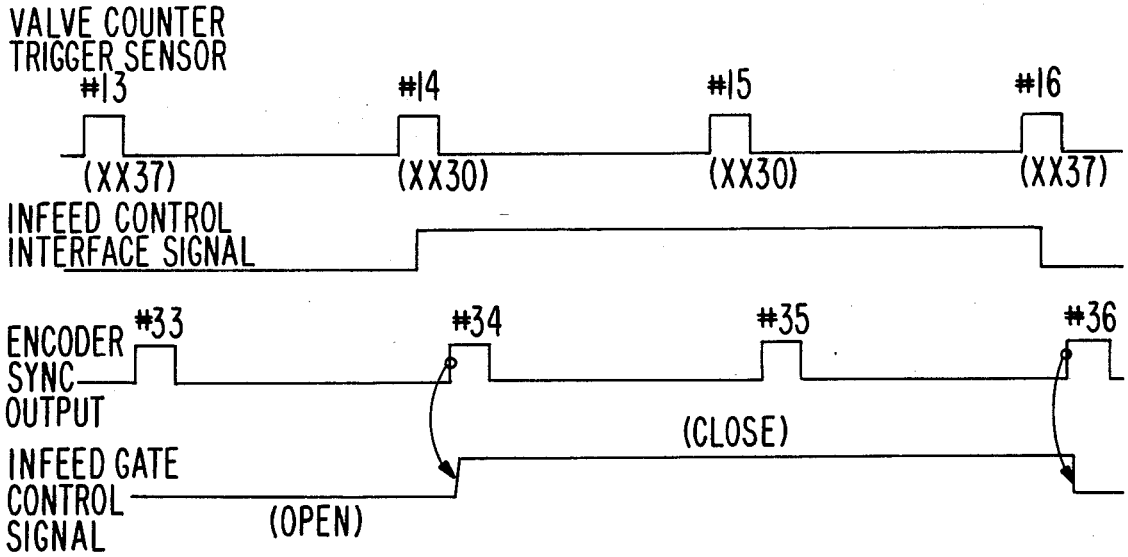
NOTE: 1) THIS TIMING SHOWS THAT TWO CONTAINERS ARE STOPPED.
2) ASSUMING THAT THE SPACE CONSTANT OF INFEED GATE ($\alpha$) IS 20.
FIG. 16 TIMING OF INFEED CONTROL OPERATION

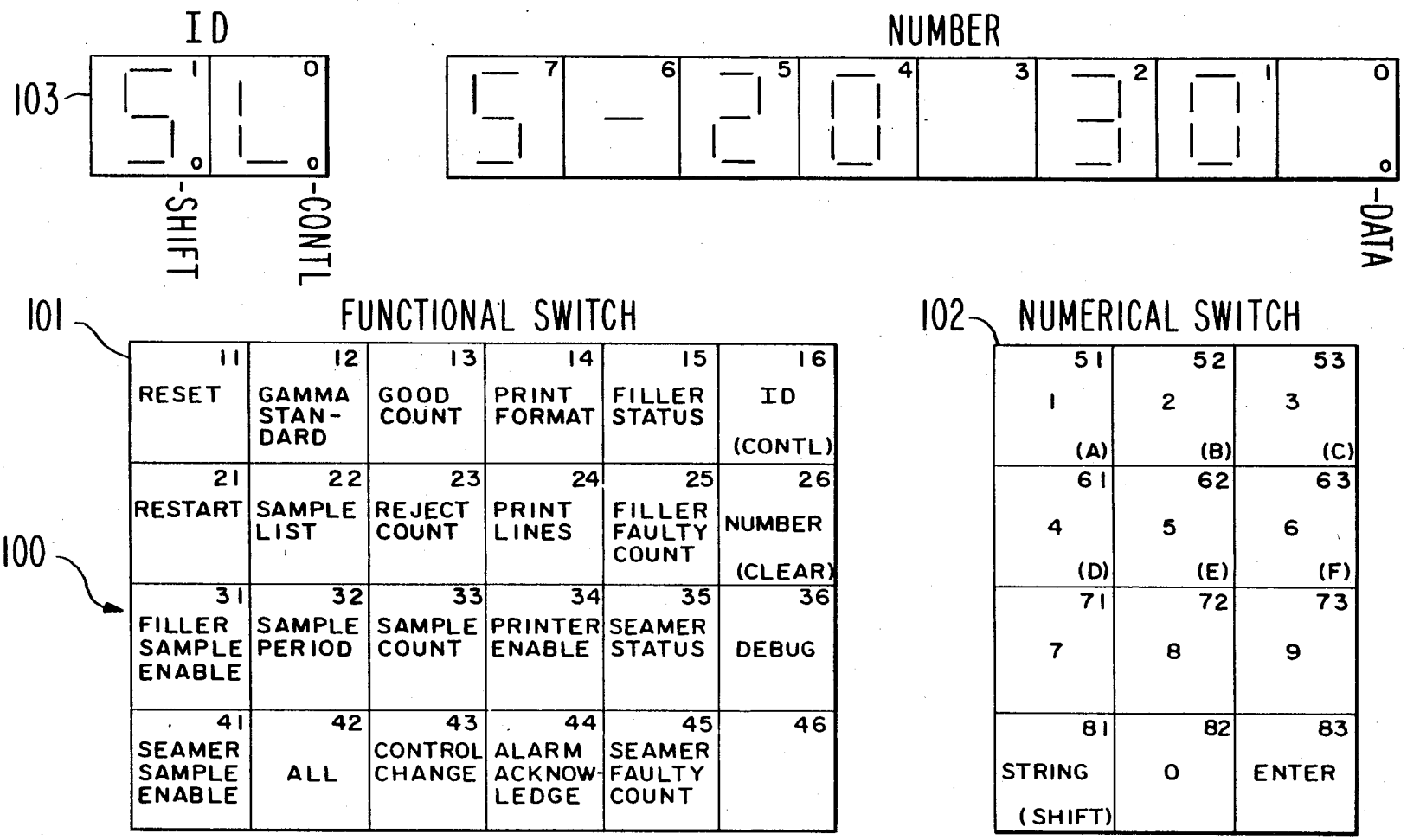
FIG. 17 SWITCHES AND DISPLAY PANEL OF FLMS SYSTEM

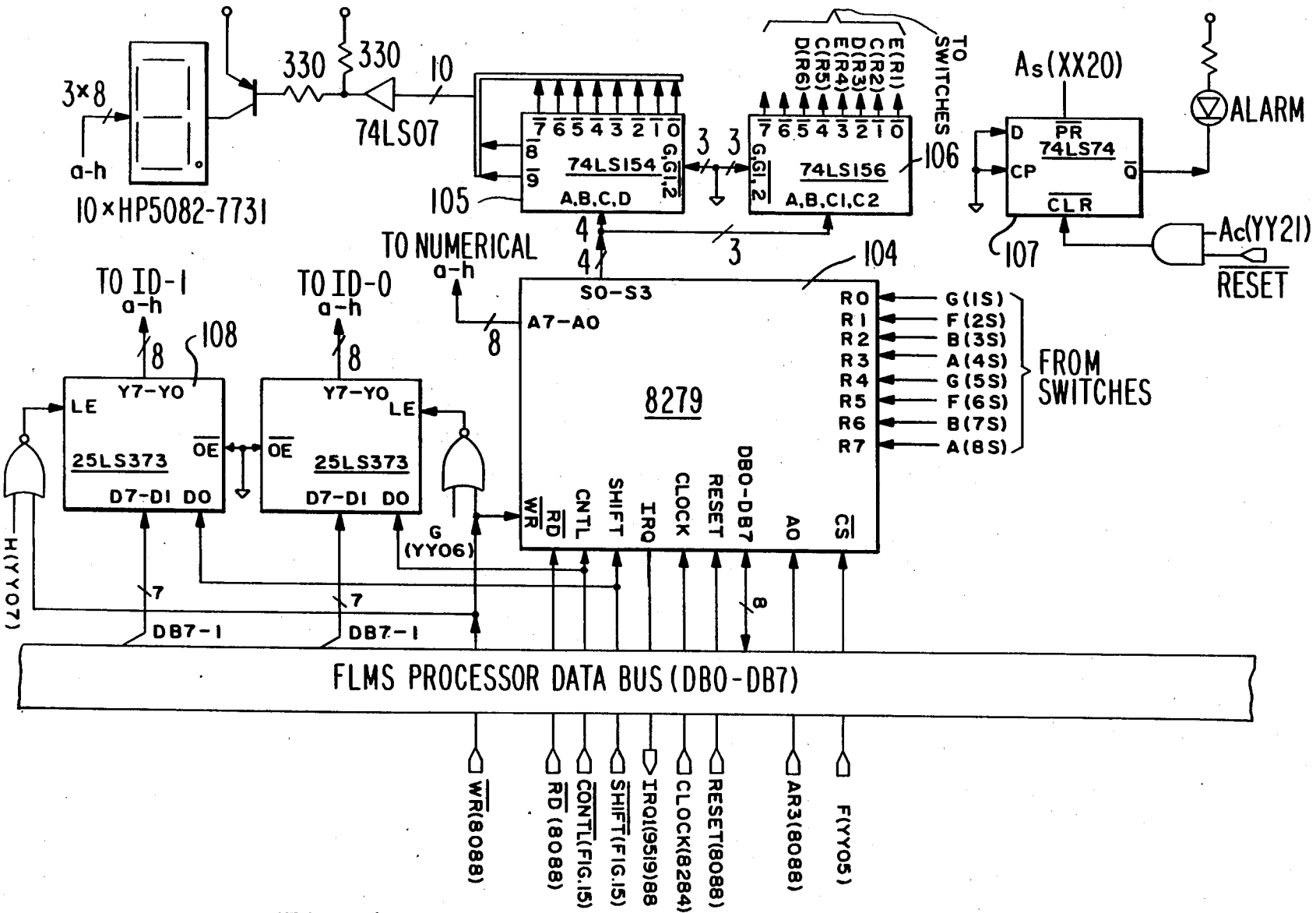
FIG. 18 SWITCH/DISPLAY BOARD CONTROL LOGIC

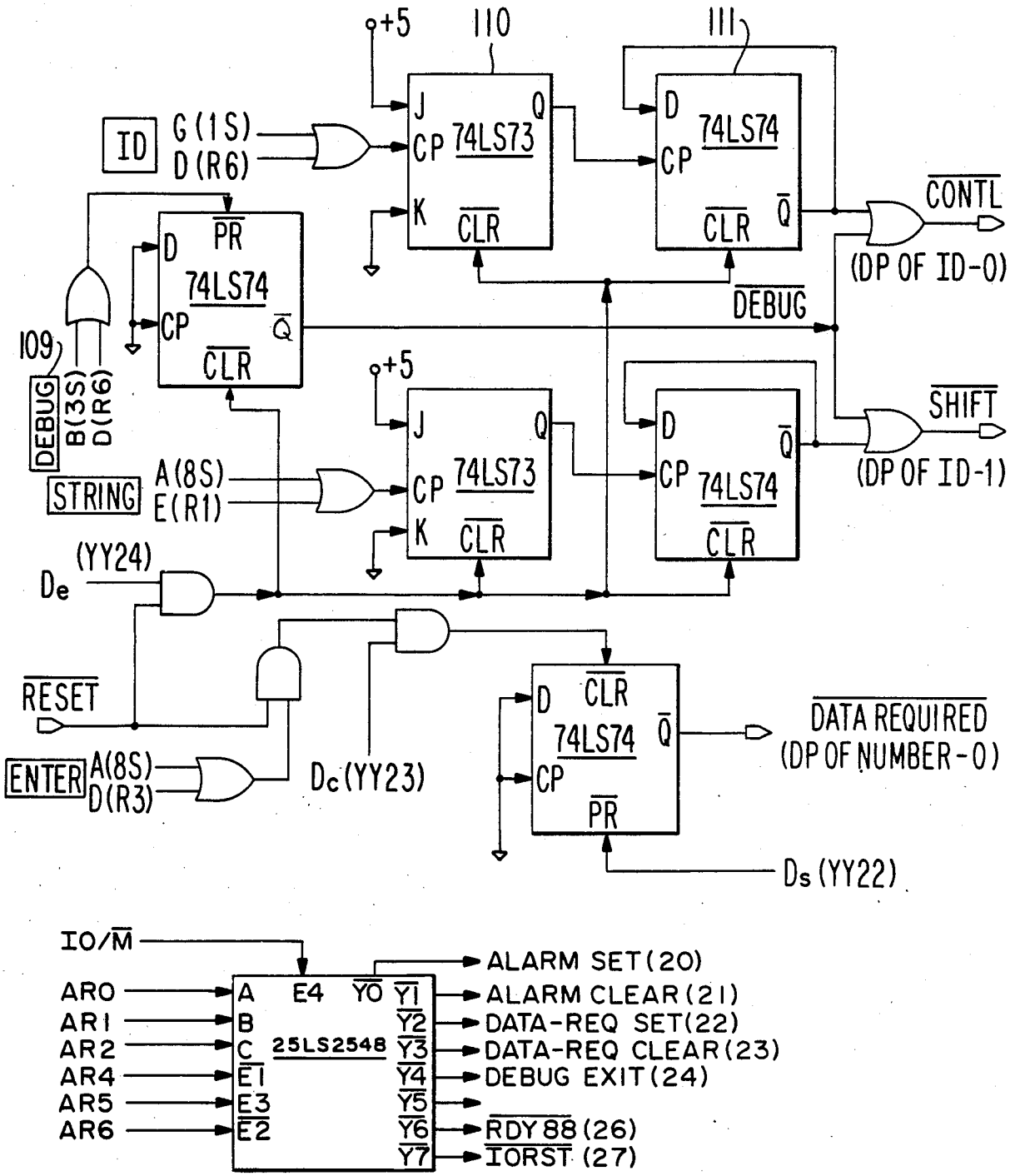
FIG. 19 HARDWARE CONTROL LOGIC FOR SWITCH/DISPLAY BOARD

FILLER LINE MONITORING SYSTEM

BACKGROUND OF THE INVENTION

1. Field of the Invention

This invention relates to high speed filler lines which are designed to fill cans and bottles and to detect automatically malfunctions in the filling and/or sealing of cans and bottles and to minimize the effect of such malfunctions. Soft drink and beer cans or bottles are typical products which are conveyed into and filled in a carrousel-type filler station, are moved into a sealer station where can lids or bottle tops are applied from where the completed containers with or without labelling are off-conveyed. The filler station typically comprises a series of can-carrying pockets which are positioned with respect to a series of full valves where simultaneous filling of the containers take place. In one form of filler station, manufactured by Crown Cork & Seal, or H & K Co., seventy-two valves are employed with seaming, (e.g., can or bottle top application) taking place downstream at seven positions within the seamer.

2. Prior Art

A system representative of the prior art is that GAMMA 101 System manufactured by F. Justus & Co., Hamburg, W. Germany. It provides a fill height detector for cases or bottles utilizing gamma rays in conjunction with means sensing missing containers and, if installed behind the filler can also indicate or identify the number of a faulty filler device. It can do this latter function due to the fact that each container goes through the filler station in a fill pocket or is otherwise evenly spaced as it exits the filler and arrives at the immediately downstream fill height detector. However, when it is desired to locate the fill height detector more conveniently in the off conveyor after the seamer or capper station, the then uneven spacing of the containers prevents the Justus device from accurately tracking containers back to a faulty valve. The prior art also shows a system where fault signals (high or low fill) from the detector are stored and the container subsequently tracked on the off conveyor to a reject station. Container reject means usable with the invention described herein are also shown.

In light of increased container and product costs and/or the high speed of filling lines, identification of either regularly occurring or intermittent problems in the valves or seamer has become increasingly important and/or difficult.

SUMMARY

The filler line monitor of this invention provides a positive identification of filler valves or seamers which are causing under-fill or over-fill or of otherwise faulty containers. This information makes possible quick and accurate problem identification, and more effective use of maintenance personnel and procedures. The result is less time spent in finding difficult problems, and ultimately, less repair downtime for the filling room equipment.

The filler line monitor system of this invention automatically and accurately identifies and traces faulty containers, identifies the causes, estimates the fill line losses associated with the faults and decides whether to prevent fill operations in a malfunctioning valve or seamer. The system utilizes a fill-height detector to inspect each container for under-fill or over-fill. Extended tracking sensing devices mounted on the filler line are used to track each container. As each faulty container is identified, the fill line monitor system immediately records the corresponding filler valve number which is responsible for the under or over-filled container, ejects the under or over-filled container from the off-conveyor and by a decision network counts the fault events in terms of improperly filled cans and decides, based on production schedules and time-to-end-of-shift, to close an infeed gate preventing a container programmed for positioning at a downstream malfunctioning fill or seal station from taking its position in the container line.

Traditionally, fill-height detectors have not been mounted near the filler/seamer area because the temporary high level of foam or turbulence in the containers distorted the fill-height reading. Accurate, digital fill-height detection allows inspection very close to the filler/seamer and direct monitoring of individual filler line performance as accomplished by the filler line monitor system.

Losses on a filler line are due to a variety of problems but studies indicate that of typical filler line losses of 0.2–1.0% of total containers arriving on the in-feed conveyor, 40–60% are related to filler valve malfunction. The malfunction may either be of fixed character, i.e., the valve under or over fills consistently or of an intermittent character, i.e., its over and under filling are random. The fill line monitoring system identifies malfunctioning specific valves and seamers and provides a means to minimize filler related losses. This is particularly accomplished by a sub-system for extended tracking of specific containers from the filling station onwardly even when the spacing between containers becomes uneven. If a valve failure is significant enough, i.e., not random, the decision network will function to prevent a container from reaching a valve which would otherwise cause under-fill or over-fill losses. The malfunctioning valve would then normally be repaired at the end of the shift. If the malfunction is random and a decision is made that useful production from a randomly malfunctioning valve exceed losses from under or over-filled containers, such containers are ejected from the off conveyor to assure product quality control.

Optionally, the fill line monitoring system may be utilized to automatically track and eject containers as samples from each of the valve/seamer/capper multi-positions for required governmental, laboratory or other visual or machine inspection.

The filler line monitoring (FLMS) system of this invention includes two methods of fill height detection. One is counting the Gamma radiation events through a photomultiplier and counters to indicate the fill height level. The other is converting the Gamma radiation energy level to a numerical data to indicate the fill height level. The user can preset some different levels through the FLMS keyboard for comparison. The FLMS processor fetches the Gamma data, event count or energy level, and compares with the preset levels to decide the rejection of the container.

The FLMS is particularly suited to aid the management and maintenance personnel in a filling plant. The basic system identified the filler valves which are consistently producing improper containers and identifies the seamer heads which are consistently producing leaking containers.

The FLMS system comprises a controlling module, a processing module, and a switch/display board. In one embodiment the controlling module is an 8085 microprocessor based system, which controls the infeed control logic; traces back the filler-valve number and the seamer-head number for each container when it is passing through the Inspection Stations, Sample Station or Reject Stations; reports the status of the containers to the processing module; and issues a sampling or ejecting command to the Sample or Reject Station.

In this embodiment the processing module utilizes an 8088 microprocessor available from Advance Micro Devices or Intel, which sums up the number of good containers, sample containers, improper filling containers and the leaking containers; counts the faulty filler and faulty seamer events; estimates the total losses during operation; decides to close the infeed gate for the worst faulty valves or heads; summarizes and stores the operation history; provides information for print, line analyzer and indicator; accepts the commands issuing from keyboard; and communicates with the controlling module.

The switch display board provides the current fill line status through eight 7-segment light emitting diodes; allows the user to program and debug the controlling and processing modules; and issues the commands to all modules.

The FLMS is structured such that one or more modules can be connected to provide the combination of features required by each application. Those modules are the fill-height module, dual fill-height module, fill-amount module, the sampling module, the ejector, the no container/no fill module, the no container/no lid module, the no valve/no container module, the filler valve detect module, the auto-weigh module, the printer, the indication board, the line analyzer, and the non-volatile memory board.

This invention will be more fully understood in light of the following detailed description taken together with the attached drawings.

BRIEF DESCRIPTION OF THE DRAWINGS

FIG. 3 are the timing pulses for the sensors of FIG. 2.

FIG. 5 are the timing pulses for the valve counter trigger and infeed encoder.

FIG. 6 is a block diagram of the microprocessor unit (MPU) and Interrupt Controller of the FLMS controller.

FIG. 7 is a block diagram of the sensor monitoring logic.

FIG. 8 is a block diagram of the calibration logic.

FIG. 9 is a schematic drawing of the control logic for the infeed and ejector operations.

FIG. 10 is a block diagram of the Inspection input interface logic and personality switch.

FIG. 12 is a block diagram of the FLMS Processor MPU and Interrupt Controller.

FIG. 13 is a block diagram of the FLMS Processor Timer and a programmable serial data communications interface providing a Universal Sync/Async Receiver/-Transmitter function (USART).

FIG. 14 is a block diagram of the FLMS Mail Boxes showing interrupt signals for communications.

FIG. 15 is a schematic drawing of the Infeed control interface logic.

FIG. 16 is a drawing of timing pulses for operation of the Infeed control.

FIG. 17 is a plan view of a switch and display panel of the FLMS.

FIG. 18 is a block diagram of the switch and display board control logic.

FIG. 19 is a block diagram of the hardware control logic for the switch/display board.

DETAILED DESCRIPTION OF THE DRAWINGS

Figure 1:
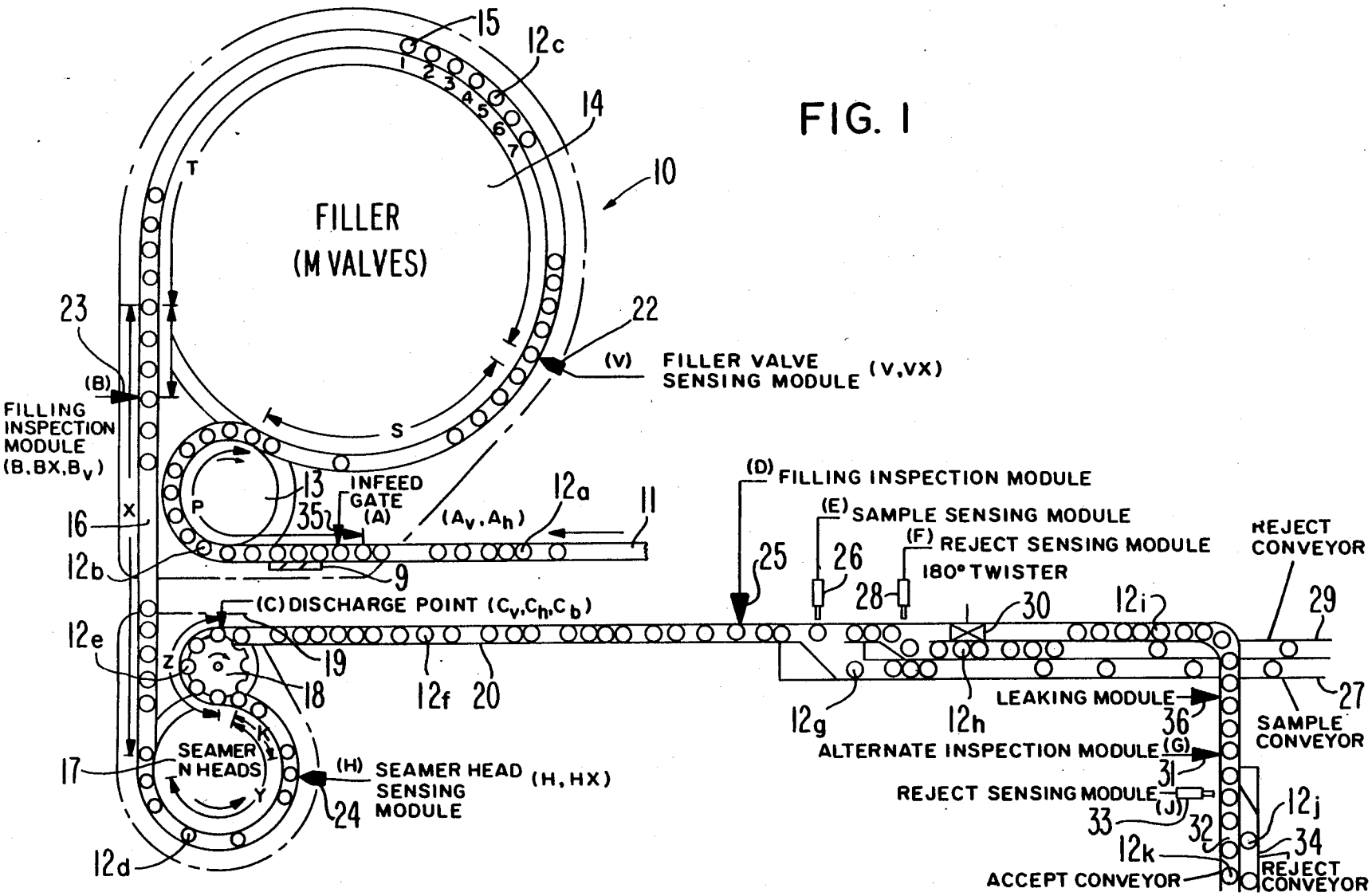
FIG. 1 is a schematic view of a typical filler line showing sensing modules for the production and quality control of the line.

FIG. 1 shows the monitoring system for the filler line. Filler line 10, the broad aspects of which are in the prior art, comprises an in-feed conveyor 11 containing a line of empty containers to be filled such as can 12*a*, a worm screw 9 which evenly spaces cans and a pocket feeder sprocket 13 which feeds containers such as can 12*b* in equal spaced positions to a rotary filler station 14 containing fill valves where a can 12*c* is filled. In a typical installation, these fill valves number seventy-two valves equally spaced around approximately 270 degrees of the carrousel-like filler station. A filler off-conveyor 16 conveys filled containers to a seamer station 17 where a can 12*d* has a can head affixed by swaging (or tightly screwed on in the case of screw caps). Containers such as can 12*e* from seamer 17 are picked off by a rotary slinger 18 and are rapidly discharged or slung off at position (C) to an end off-conveyor 20. At this point containers such as can 12*f* are unevenly spaced due to the unmatched speed rates and nonsynchronous movement of the various parts of the filler line. The random or uneven nature of the line of containers at this point presents a particular difficulty in tracking a particular can to its particular fill valve or seamer module.

The invention herein monitors and controls the broad filler line 10 described above. This is accomplished by first providing for a series of sensors and sensing modules at selected positions in the filler line. A filler valve sensing module 22 consisting of three sensors is provided at Location (V) to count the "number" of the valve, to sense the triggering of the valve to open and to indicate presence (or nonpresence) of a container in a valve pocket. An initial filling station fill-height inspection module 23 is provided at Location (B), a seamer head sensing module 24 at Location (H), a discharge sensing module 19 at Location (C), a second fill-height inspection module at Location (D), a sample sensing module 26 at Location (E) with means to move a container such as can 12*g* to a sample off-conveyor 27, a reject sensing module 28 at Location (F) with means normally solenoid operated to move a faulty container (over or under-filled) such as can 12*h* to a reject conveyor 29. All containers "passing" inspections at this point are rotated or twisted 180° so as to be upside down by twister 30 so that a container such as can 12*i* can be tested for leakage. This is done by conveying the containers through alternate fill height inspection module 31 at Location (G). Containers failing this inspection are rejected by reject sensing module 33 to reject conveyor 34 (can 12*j*) and fully acceptable cans such as can 12*k* are off-loaded or conveyed to labeling machines from accept conveyor 32.

An Infeed control module 35 is provided at Location (A), along with an In-feed gate (FIG. 20) to control the nonentry of a container to a malfunctioning valve or seamer position as dictated by the decision network hereinafter described. A leaking inspection sensing module 36 is provided after twister 30.

FILLER VALVE SENSING MODULES

The filler valve sensing module 22 and the seamer head sensing module 24 comprise three sensors which are Number-one, Trigger and Calibration sensors. The inspection sensing module 23, sample sensing module 26, reject sensing module 28, and discharge sensing module 19 normally comprise one sensor each. The filler valve sensing module 22 although shown at Location (V) may be located at any position between the entry pocket and the exit pocket of the filler station 14. The optical location which reduces the processing time of microprocessor routines can be decided by means of the following equations.

$$T=mM-(X+Y+Z) \quad (1)$$

for which the Inspection module is located down stream of the seamer or $$T=mM-W \quad (2)$$

for which the Inspection module is located between filler and seamer.

where

M is the total number of filler valves, m is the multiplier, integer,

T is the number of pockets between the filler valve sensing module and the exit pocket of the filler station, X is the number of pockets between filler-exit and seamer-entry, Y is the number of pockets between seamer-entry and seamer-exit, Z is the number of pockets between seamer-exit and container-discharge sensing module, W is the number of pockets between filler-exit and the inspection module.

The secondary optimal location can be determined by the following equation:

$$S=mM-P \quad (3)$$

where

S is the number of pockets between filler-entry and the filler valve sensing module, P is the number of pockets between filler-entry and the infeed control gate.

Figure 2:
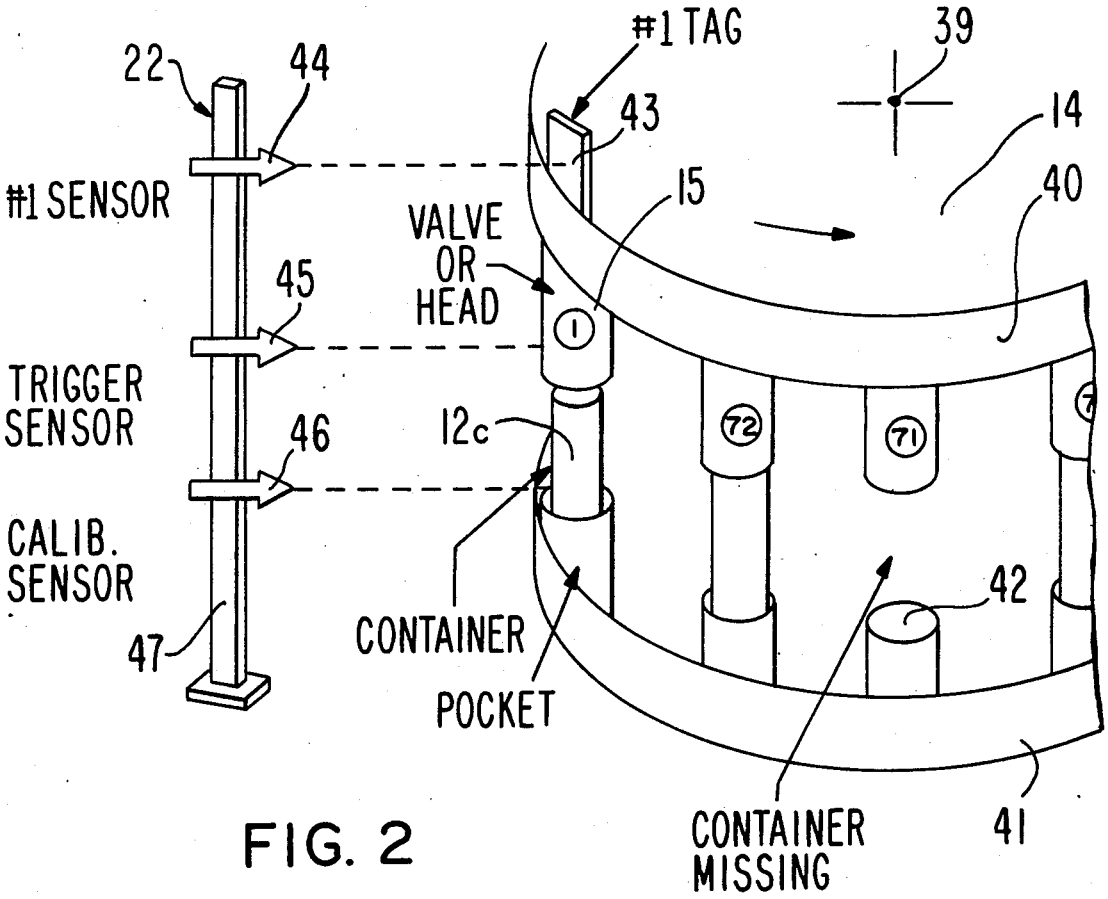
FIG. 2 is a schematic view of the orientation of the sensors at the filler valve station.

The filler valve sensors are shown in FIG. 2. Filler station 14 rotates about axis 39 and comprises a top circular member 40 holding the multiple fill valves 15 and a bottom rotary member 41 having upstanding container-holding pockets 42. Containers such as can 12*c* are positioned with their open tops facing a downwardly-facing outlet of the fill valve 15. A metal tab 43 upstanding from top 40 functions as a marker for the No. 1 numbered valve. A series of sensors making up module 22 are vertically mounted on post 47.

Filler valve Number-one sensor 44 aims at the upstanding #1 tag 43 of filler top 40. Filler valve counter trigger sensor 45 aims at valve 15 or succeeding valves as they pass by the valve sensor module. A calibration sensor 46 aims at the container space to inform as to the presence or absence of a container in a pocket 42.

The timing relationship between the three sensing signals is shown in FIG. 3. Wave form 65 represents the timing pulses feeding into sensor 45 with spacings between pulses representing the time period between fill pockets of the filler station. Waveform 66 represents a sensor output pulse representing sensor 44 signifying presence of Tag No. 1. Waveform 67 represents the calibration pulses to sensor 46 which indicates the presence or nonpresence of a container in a fill (or seamer) pocket. The timing relationship between the filler valve counter trigger sensing signal and the encoder output of the infeed control module is shown in FIG. 5. Waveform 68 represents a pulse from an encoder providing an output signal (encoder sync output) as shown in FIG. 15 functioning to syncronize with worm screw 9 (FIG. 1) and to initiate the decision to place or not place a container in that then existing position of the worm screw.

The filler valve Number-one sensing signal from sensor 44 resets a valve counter to 1 whenever the #1 tag passes through the filler valve sensing module. The filler valve counter trigger sensing signal from sensor 45 triggers the valve counter and the calibration counter-1 whenever a filler valve passes through sensing module 22. The calibration sensor-1 signal resets a calibration counter to calibration-constant (CC) whenever a container is passing through the sensing module 22. The calibration constant (CC) is the programmable number of missing containers for activating the calibration procedure. The calibration counter starts counting down when a missing container occurs and resets to CC when a container presents. If the number of consecutive missing containers is equivalent to or greater than the preprogrammed CC, the output of valve counter (VX) is latched into a latch 79 (FIG. 8) and the calibration counter-2 is being enabled as hereinafter explained.

SEAMER HEAD SENSING MODULE

The seamer head sensing module 24 although shown at Location (H) is located at any position between the entry pocket and the exit pocket of the seamer 17. The optimal location can be determined by the following equation:

$$K=nN-Z \quad (4)$$

where

K is the number of pockets between the seamer head sensing module and the exit pocket of seamer, Z is the number of pockets between seamer-exit and the container discharge sensing module, N is the total number of seamer heads, n is the multiplier, integer.

The vertical positions of the seamer head sensors are similar to those shown in FIG. 2 namely a seamer head Number-one sensor which aims at a #1 tag on the seamer, a seamer head counter trigger sensor which aims at the seamer head, and a calibration sensor-2 which aims at the container. The timing relationship between those three sealer sensing signals is similar to those shown in FIGS. 3 and 5 for the valve sensing signals.

The seamer head Number-one sensing signal resets a seamer head counter to 1 whenever the #1 tag of the seamer is passing through the seamer head sensing module. The seamer head counter trigger sensing signal triggers the seamer head counter and the calibration counter whenever a seamer head is passing through the sensing module. The calibration sensor-2 signal resets the calibration counter-2 to calibration-constant (CC) whenever a container is passing through the sensing module.

The sensors used herein for sensing the Number-one tag and the triggering sensor (e.g, sensors 44 and 45 and their seamer head counterparts) are normally proximity sensors which detect metal and provide a logic output. An example of such sensor is the AC or DC supply voltage Model RL round logic sensors commercially available from Peco Controls Corporation, Milpitas, Calif. Sensor 46 may be of the above type or be a photoelectric or optical sensor employing a solid-state photoelectric receiver and an infrared LED light transmitter. An example would be Models B-3455 and B-3456 also commercially available from Peco Controls. These sensors may also be utilized for the other sensors of the fill monitoring system.

CONTAINER DISCHARGE SENSING MODULE

The container discharge sensing module 19 is located at the discharge point (C). The sensor aims at the passing container such as can 12*e*. The sensing signal triggers the container discharge routine (see "Software Description" for detail), resets a calibration counter-3 to calibration constant (CC) and resets a calibration counter-4 to synchronization constant (SC).

FILLING INSPECTION SENSING MODULE

The filling inspection sensing modules 23 and 25 are associated with a fill height indicator. An example of such indicator is the Gamma 101/102 detector commercially available from F. Justus & Co. and Peco Controls. There are two locations for the Gamma 101/102 detectors, one between the filler-exit and the seamer-entry typically at Location (B), the other at Location (D) between the container-discharge at Location (C) and the sample module at Location (E). The Gamma-ray sensor at the latter location aims at a passing container such as can 12*f* to determine low or high-fill.

The inspection sensing signal from the Gamma detection unit triggers the inspection routine and resets a calibration counter-5 to calibration constant (CC).

SAMPLE SENSING MODULE

The sample sensing module 26 is located at the Sampling station. The sensor aims at the passing container. The sensing signal triggers the sample procedure and ejects particular containers such as can 12*g* for sampling purposes.

REJECT SENSING MODULES

The reject sensing module 28 is located at the Reject station. The sensor aims at the container. The sensing signal triggers the Reject routine and ejects a faulty container such as can 12*h* when it has been determined that that particular can is faulty.

SAMPLE/REJECT SENSING MODULE

The sample/reject sensing module is located at the Sample/Reject station and is used when one conveyor functions in place of coveyors 27 and 29. The sensor aims at the container. This sensing signal triggers the Sample routine and the Reject routine. Reject and sample containers move from the system on one conveyor (not shown). The output is connected to two inputs of the interrupt controller.

LEAKING INSPECTION SENSING MODULE

The leaking inspection sensing module 31 is associated with another fill height indicator such as a Gamma 101 detector. The Gamma 101 detector is located down stream and after the 180° Twister 30. The Gamma-ray sensor aims at each container.

ALTERNATE INSPECTION SENSING MODULE

The alternate inspection module 31 is used to associate with any kind of additional inspection or detection method, such as indicating a missing cap or missing or misapplied label.

SYSTEM ARCHITECTURE

Figure 4:
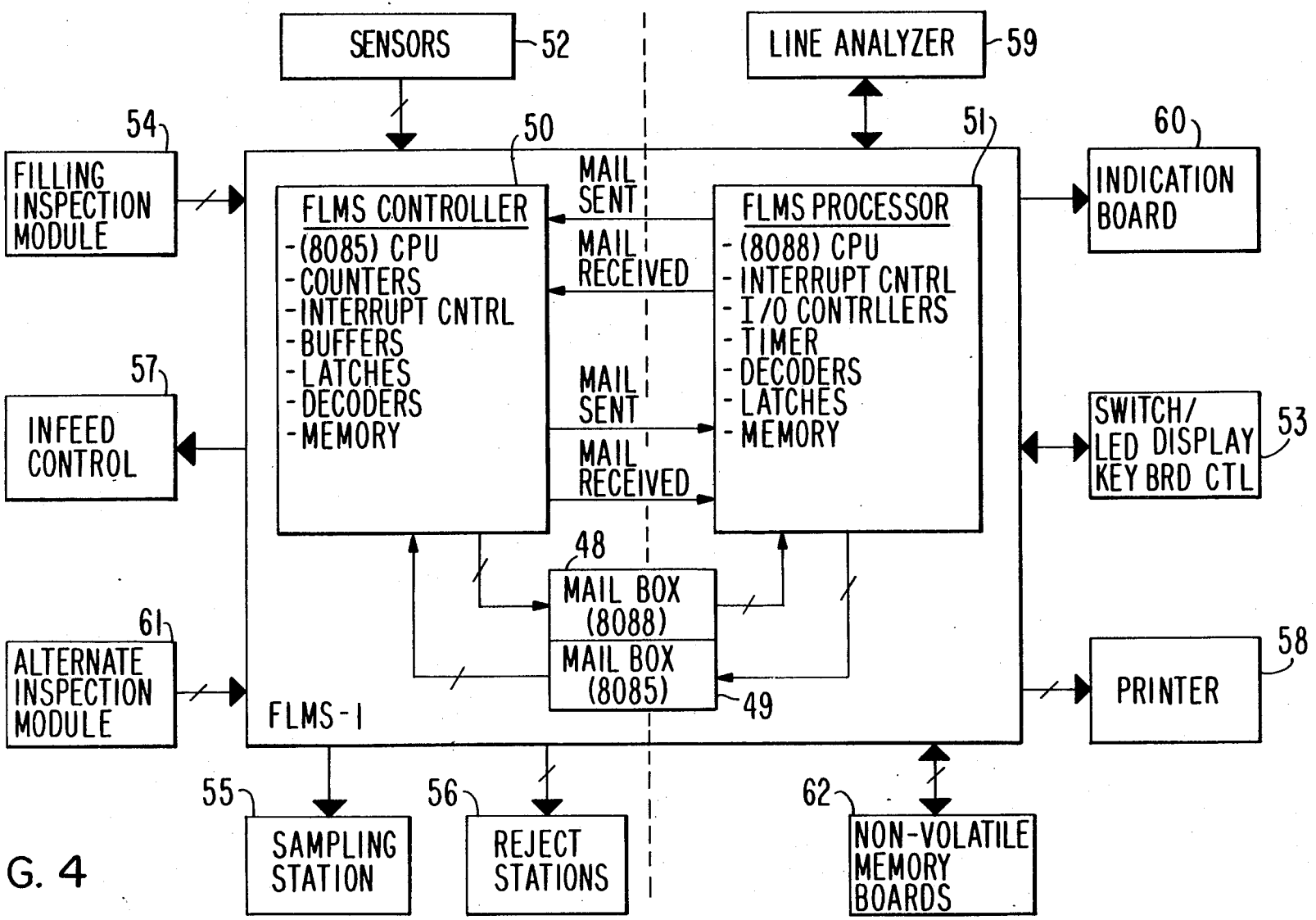
FIG. 4 is a block diagram of the FLMS.

The FLMS system shown in FIG. 4 comprises two independent microprocessor based modules, a controller module 50 (FLMS Controller) and the processing module 51 (FLMS Processor), sensor modules 52, and switch/display board 53.

The FLMS Controller and Processor communicate with each other by means of "Mail Boxes" 48 and 49. The mail boxes are comprised of three latches and function as storage devices until the CPU being addressed is ready to receive the proffered information. Messages are the result of the inspection process and are shown in Appendix A. Whenever a message is placed in the mail box, the sender issues a "mail sent" signal to the receiver. The receiver will pick up the message and then issue a "mail received" signal to the sender as shown by the arrows between blocks 50 and 51.

The FLMS Controller, monitoring the real time operation of the filler line, is connected to all sensor modules 52, Inspection modules 54, Sampling module and station 55, Reject modules or stations 56, and Infeed Control module 57. The FLMS Processor is connected to Switch/Display board 53, Printer 58, Line Analyzer 59, and Indication board 60. Alternative Inspection module 61 and nonvolatile memory boards 62 may also interface with the FLMS. The interaction of the sensor modules shown in FIG. 1 and explained above interact with the FLMS Controller and Processor as will now be explained. Whenever a filler valve counter counts up once, the 8085 CPU (a unit available from Advance Micro Devices or Intel) determines which filler valve is going to fill or which seamer head is going to seal the container that presents itself at the infeed sensor adjacent the infeed gate. The equations are $$A_v = V + a - mM \tag{5}$$

$$A_h = H + b - nN \tag{6}$$

where $A_v$ is the valve number which the container at the infeed gate is to be filled by;

$A_h$ is the head number which the container at the infeed gate is to be sealed by;

V is the reading of the filler valve counter;

H is the reading of the seamer head counter;

a is the space constant of infeed-to-valve, i.e., the number of pockets between the Infeed gate and the filler valve sensing module;

b is the space constant of infeed-to-head, i.e., the number of pockets between the Infeed gate and the seamer head sensing module;

M is the filler size, i.e., the total number of valves;

N is the seamer size, i.e., the total number of heads;

m is a multiplier for setting that $0<A_v \leqq M$;

n is a multiplier for setting that $0<A_h \leqq N$;

Whenever a container is discharged from the discharge point the 8085 MPU (or CPU) determines which filler valve did the filling job and which seamer head sealed the lid or cap. The equations are $$C_v = V - k + mM \quad (7)$$

$$C_h = H - h + nN \quad (8)$$

where $C_v$ is the valve number which filled the container at the Discharge point;

$C_h$ is the head number which sealed the container at the discharge point;

k is the space constant of valve-to-discharge, i.e., the number of pockets between the filler valve sensing module and the discharge point; p1 h is the space constance of head-to-discharge, i.e., the number of pockets between the seamer head sensing module and the discharge point;

m,n are the multipliers for setting that $0<C_v \leqq M$ and $0<C_h<N$.

If the filling inspection sensing module 23 is located between the filler and the seamer e.g., at Location (B) in FIG. 1, when a container exists at filling inspection sensing module 23 the 8085 MPU determines which filler valve filled this container. The equation is $$B_v = V - g + mM \quad (9)$$

where $B_v$ is the filler valve number which filled the container;

V is the reading of the filler valve counter;

g is the space constant of value-to-B, i.e., the number of pockets between the filler valve sensing module 22 and the filling inspection module 23 at Location (B);

m is a multiplier for setting that $0<B_v \leqq M$.

The MPU reports the inspect results to the FLMS Processor and stores the reject information in a Reject Table. The location is determined by the reading of the Counter (B) shown as Counter 75 in FIG. 7. When a container exits at the discharge sensing module 19, the MPU reads the Counter (B) and calculates the location of the reject information for this container. The equation is $$C_b = B - f + n' \cdot (256) \quad (10)$$

where $C_b$ is the pointer of the Reject Table for the container at discharge point;

B is the reading of counter (B);

f is the space constant of Location (B)-to-Discharge, i.e., the number of pockets between the Filling Inspection module at Location (B) and the Discharge point (C);

n' is a multiplier for setting that $0<C_b \leqq 256$.

Note that the space constants must be adjusted for fitting in the ranges of 0 to M−1, 0 to N−1, or 0 to 255.

The equations are $$a = S + P - mM \quad (11)$$

$$b = S + P + T + X + L - nN \quad (12)$$

$$f = X + Y + Z - W - n' \cdot (256) \quad (13)$$

$$g = T + W - mM \quad (14)$$

$$h = K + Z - nN \quad (15)$$

$$k = T + X + Z - mM \quad (16)$$

where

S, P, L, T, W, X, Y, Z and K are the numbers of particular pockets, (see FIG. 1);

n is a multiplier for setting that $0 \leqq b, h<N$;

m is a multiplier for setting that $0 \leqq a, g, k<M$;

n' is a multiplier for setting that $0 \leqq f<256$.

The parameters P, X, Y, Z, N, M are fixed, but S, T, W, K, L are adjustable. The optimal locations of "V", "B" and "H" modules will set the constants to zero and then reduce the processing time.

FLMS CONTROLLER

The FLMS controller 50 is an 8085 microprocessor based system. As shown in FIG. 6, it comprises an 8085 MPU 70, a 9519 Interrupt Controller 71, the sensor monitoring logic, the calibration logic, the control logic, the inspection input logic, the personality switch, and the memory.

8085 MICROPROCESSOR

The 8085 MPU preferably runs at 4 MHz. The interrupt inputs into MPU 70 are used for the following operations:

(a) TRAP: indicates that the synchronization routine is being requested. p1 (b) RST7.5: indicates that a container is existing at the filling inspection station. The filling inspection routine is called.

(c) RST6.5: indicates that a container is existing at the container discharge module. The Container Discharge routine is being requested.

(d) RST5.5: indicates that the calibration routine is being requested.

(e) INTR: indicates that an interrupt routine is being requested.

MPU 70 controls the memory transactions and I/O (Input/Output) transactions. It issues a command to the control logic by means of the method of I/O address decoding. It fetches the data from the sensor monitoring logic, the inspection logic and the mail box through the latches or buffers by means of I/O transactions. Block 72 represents a transceiver which functions to pick up and place data on the data bus. Block 73 represents a latch functioning to latch address and data line. Block 74 is an address decoder which functions to control peripheral devices. MPU initialization procedure for different installations of the inspection station is controlled by a personality switch 86 (FIG. 10). When its D0 bit is '0' (LOW), the inspection station is installed at a position down stream of the seamer. When the inspection station is installed between the filler-exit and the seamer-entry, the D0 bit of the personality switch should be '1' (HIGH).

INTERRUPT CONTROLLER

The 9519 interrupt controller 71 also available from Advance Micro Devices or Intel is a programmable controller. It makes interrupt request to MPU 70 whenever its interrupt request input is active LOW. The eight Interrupt Request inputs are used for the following operations:

IREQ0: reserved for expansion.

IREQ1: indicates that a container is existing at the alternate inspection station. The Alternate Inspection routine is requested.

IREQ2: indicates that a container is existing at the reject station-#1. The Sampling routine or the Sampling/Reject routine is requested.

IREQ3: indicates that a container is existing at the eject station-#2. The Reject routine or the Sampling routine is called.

IREQ4: indicates that a container is existing at the eject station-#3. The alternate Reject routine is called.

IREQ5: indicates that the message in the FLMS Processor's mail box has been received. The Mail Received routine is called.

IREQ6: indicates that the FLMS Processor has sent a message to the FLMS Controller's mail box. The Mail Pick-up routine is requested.

IREQ7: indicates that the first container is existing at filler valve sensing module. The initialization routine is called. This interrupt is activated once only after system reset.

All of the interrupt request inputs except IREQ5, 6, 7 are masked after system reset and before the completion of the initialization routine. Any other interrupt request will be ignored. Eject staions #1, #2 and #3 are at Locations (E), (F) and (J) in FIG. 1.

SENSOR MONITORING LOGIC

The sensor monitoring logic consists of six binary counters 75 (74191), three tri-state buffers 76 (25LS244) and one address decoder 74 (25LS2548). These units are available respectively from AMD. FIG. 7 shows the block diagram of the sensor monitoring logic. The Valve #1 sensing output and the Head #1 sensing output are connected to the Parallel Load ($\overline{PL}$) inputs of the valve counters 75*a* and *b* and the head counters 75*c* and *d*, respectively. They reset the counter to '1' when the #1 sensing signal is active LOW.

The output of the filler valve counter trigger sensor is connected to the Clock Pulse (CP) input of the least significant counter 75*b*. The Ripple Clock ($\overline{RC}$) output of the least significant counter is connected to the CP input of the most significant counter 75*a*. Therefore, they provide for eight bit binary counting. The outputs of counters are connected to 8-bit buffers 76, which Output Enable ($\overline{OE}$) is connected to the output of the address decoder (XX00/XX40), for example, at 77.

CALIBRATION LOGIC

FIG. 8 shows the calibration logic which is used to calibrate the position and spacing of the sensors and comprises six binary counters 78 (74191), five tri-state latches 79 (25LS373), thirteen (three for each of counters 78) D-type flip-flops 80, and twelve TTL logic gates 81. The calibration Constant (CC) and Synchronization Constant (SC) are programmable. They represent the number of missing containers. For instance, if the Calibration Constant is preprogrammed as '8', whenever a gap of missing containers is greater than 7 the calibration procedure is enabled. When the first container which is followed the gap passes through the calibration sensor-1, the output of valve counter (VX) is latched, the calibration counter-1 is disabled and the calibration counters-2,5 are enabled. When the leading container passes through the calibration sensor-2, the output of head counter (HX) is latched, the calibration counter-2 is disabled, and the calibration counter-3 is enabled. When the leading container passes the discharge sensor, the calibration routine is called. The MPU will read the values of V, VX, H and HX, calculate the number of pockets between filler valve sensing module and container discharge sensing module, and calculate the number of pockets between seamer head sensing module and container discharge sensing module. If the filling inspection sensing module is located between the filler and seamer, the MPU will read the values of B and BX, and calculate the number of pockets between filling inspection sensing module and container discharge sensing module.

The number of pockets between sensing modules can be derived as:

$$K=V-VX+mM \tag{17}$$

$$h=H-HX+nN \tag{18}$$

$$g=V-VX+m'M \tag{19}$$

$$f=B-BX\pm n'(256) \tag{20}$$

where g, h, k and f are the space constants;

V, VX, H, HX, B, BX are the reading of buffers and latches.

n, n', m, m' are multipliers, integers, for $0\leqq k<M$ and $0\leqq H<N$.

The synchronization check routine is called whenever a gap of missing containers is greater than the pre-programmed value of the synchronization constant. The MPU will check all of the table pointers for the downstream modules.

The programmable constants, CC and SC, are determined by following rules:

| CONSTANT | RANGE | RULE |
|---|---|---|
| Calibration Constant | 1 to 15 | Less than the minimum number of pockets between two sensing modules which are located before discharge point. |
| Synchronization Constant | 1 to 255 | Greater than the maximum number of containers that can exist between discharge pointer and the last module. |

CONTROL LOGIC

FIG. 9 illustrates control logic providing control signals for infeed control, sampling, filling reject, and leaking reject. The MPU issues a command by means of a IO-WRITE instruction to a particular address. An address decoder sends out the command to a flip flop or a nonretriggable timer. The pulse widths of the ejector signals are adjustable. The infeed control signal is sent to the infeed control module. Block 82 represents a pair of RS flip-flops functioning to give a ready signal and an infeed control signal, and blocks 83 represent timers which function to control the ejection solenoid.

INSPECTION INPUT INTERFACE LOGIC

FIG. 10 shows the inspection modules for detection of the fill height by means of gamma radiation. A Gamma-101 module 25 (FIG. 1) provides the following information:

Total Reject—indicates that the container will be rejected. p1 Underfull—indicates that the fill height of the container is under the desired level.

Overfill—indicates that the fill height of the container is over the limit set.

Missing Cap—indicates that the container does not have a cap or top.

High Cap—indicates that a high-cap (indicating improper capping) container exists.

Those data are latched whenever the decision is made. The MPU reads those data during inspection routine.

A Gamma-201 module 23 (FIG. 10) provides the quantity of filling by means of sixteen datum-lines whenever the detection is completed. The sixteen-bit data are the count of Gamma radiation events or the numerical data of Gamma radiation energy level. The Gamma radiation events are counted by means of a photomultiplier, e.g., 6199A photomultiplier made by RCA, and the digital counters. The photomultiplier is operated in pulse mode. The Gamma radiation energy level is measured by means of a photomultiplier which is operated at current mode and the Analog-to-Digital converter.

The sixteen-bit data are latched in the 25LS373 latches whenever the detection is completed. The 8085 MPU will read those data when the RST7.5 routine or the IREQ1 routine is being executed. Blocks 84*a* and 85*b* latch data from a Gamma-201 module, when that module is used by itself or with a Gamma-101 or Gamma-102 model unit. Block 85 (25LS244) is a buffer. The MPU reads those data during inspection routine. Personality switches 86 (S1, S2) indicate which module is used. The following table lists the switch setting and data distribution.

| INSPECTION TYPE | | GAMMA-101,102 | GAMMA-201 |
|---|---|---|---|
| FILLING | S1 Setting | OFF | ON |
| | Port (High) | XX25 (OVERFILL) | XX25 |
| | Port (low) | XX21 (UNDERFILL) | XX21 |
| ALTERNATE e.g., (leaking) | S2 Setting | OFF | ON |
| | Port (High) | XX24 (NO CAP) | XX24 |
| | Port (Low) | XX22 (LEAKING) | XX22 |

PERSONALITY SWITCHES

The personality switches 86 provide information as to the location of the filling inspection module, the type of inspection logic, the detour the control signal. The definitions of the personality switches are listed on the following table.

| SWITCH | FUNCTION | ON "0" | OFF "1" |
|---|---|---|---|
| S0 | Location of Filling Inspection Module | Down Stream | Middle Stream |
| S1 | Type of Filling Inspection Module | GAMMA-201 | GAMMA-101,102 |
| S2 | Type of Alternate Inspection Module | GAMMA-201 | GAMMA-101,102 |
| S3 | Infeed Gate Installation | YES | NO |
| S4 | Eject Station-#1 | Sampling | Sampling/Reject |
| S5 | Eject Station-#2 | Reject | Sampling |
| S6 | Installation of No Valve/No Container | YES | NO |
| S7 | Spare | | |

The MPU fetches in the settings of the switches S0, S1, . . . , and S7 through the data bus D0–D7. The selected inspection routines will be set up during the initialization cycle.

Switches S4, S5, S6 and S3 are the "OPTIONS" switches for detouring of installations. For example, when only one ejector is used for sampling and rejecting, the switch S4 should be "OFF" and the solenoid of the ejector must be connected to output the "EJECTOR SOLENOID—#1".

MEMORY

Figure 11:
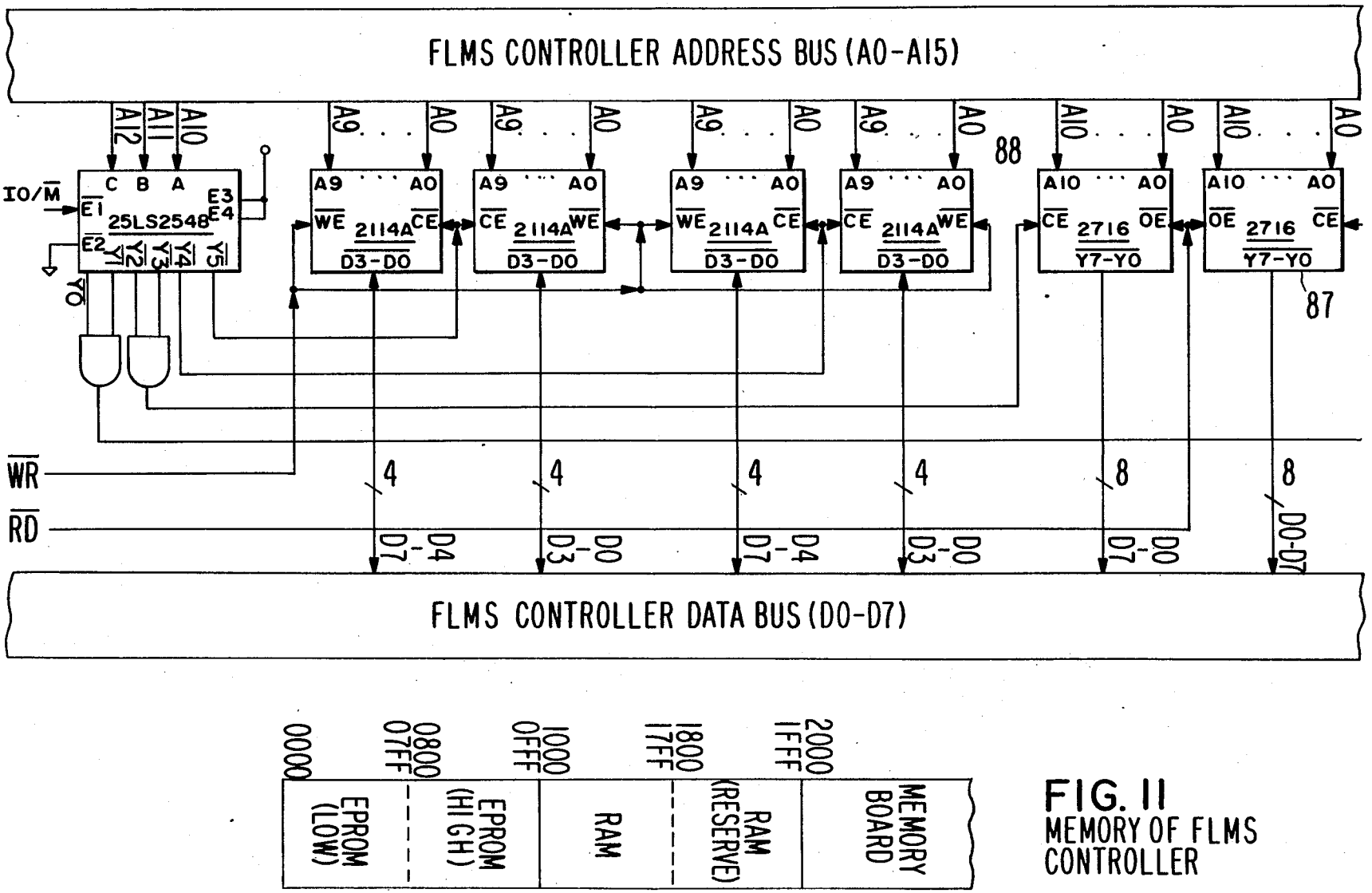
FIG. 11 is a block diagram of the memory of the FLMS Controller.

FIG. 11 shows the memory of the FLMS controller and its control logic. The memory includes 4K bytes EPROM 87 (2716 units) and 2K bytes random access memory (RAM) 88. The EPROM is addressed from (0000) to $(0FFF)_{16}$ and RAM is from $(1000)_{16}$ to $(17FF)_{16}$. Whenever the power is OFF, the data stored in the RAM are destroyed. The addresses from $(1800)_{16}$ to $(1FFF)_{16}$ may be reserved for RAM expansion.

FLMS PROCESSOR

The FLMS processor 51 is an 8088 microprocessor based system shown in FIGS. 12 and 13. It comprises an 8088 MPU 90, a 9519 Interrupt Controller 91, a 9513 programmable system timing controller 92, two 9551 universal sync/async receiver/transmitters 93 (USART), 8284 clock generator 94, address decoders, latches and memory. The latter units are available commercially from various sources.

8088 MICROPROCESSOR

The 8088 MPU runs at 4.9152 MHz. It processes the FLMS monitoring data, analyzes the filler line situation, predicts the total losses, judges the performance of each valve or head, decides to close the infeed gate for badly malfunctioning valves or heads, responds to requests from switch/display board, prepares the data for reports, and communicates with line analyzer and FLMS controller.

FIG. 12 is the block diagram of 8088 MPU 90 and 9519 interrupt controller 91 with latches and decoders. The 8088 MPU is operated in minimum mode. The data transactions for the peripherals are through the input-/output instructions. The address bit A3 at 92 is for the command/data inputs of the peripherals. The non-maskable interrupt (NMI) input at 95 is for the interrupt request of data sent from the FLMS controller. The interrupt request (INTR) input is connected to the 9519

Interrupt Controller-2. The READY signal of the 8284 clock generator 94 will hold the MPU when it is low.

INTERRUPT CONTROLLER

The 9519 interrupt controller 91 for the FLMS processor module provides the interrupt request, vectors for print routine, line analyzer routine, indication routine, periodical sampling routine, and switch/display routines. The right interrupt request inputs are assigned as follows:

- IRQ0: Indicates that the mail sent to FLMS controller has been picked up.
- IRQ1: Indicates that one of the switches at switch-/display board is pushed, and the fetching routine is called.
- IRQ2: Indicates that a preprogrammed timing period is pulsed, a timer routine is updated, and/or a periodical samling is enabled.
- IRQ3: Indicates that the indication board is not busy and indication routine is called.
- IRQ4: Indicates that the line analyzer is requesting the data, a send-data routine is called.
- IRQ5: Indicates that the line analyzer is ready for sending data, a fetch-data routine is called.
- IRQ6: Reserved for expansion.
- IRQ7: Indicates that the printer is ready for receiving data, a print routine is being requested.

SYSTEM TIMING CONTROLLER

As seen in FIG. 13 the 9513 system timing controller 92 serves many types of counting, sequencing and timing applications. It provides five independent 16-bit counters (OUT1 through OUT5) and a programmable frequency output (FOUT). The counter-1 and counter-2 in timer 92 operate at Time-of-Day (TOD) mode. Counter-3 provides the BAUD rate (bits per second) signal from the USART to a printer. The counter-4 provides the BAUD signal from the USART to an indication board. The counter-5 provides BAUD signal from the USART to the line analyzer.

9551/8251 UNIVERSAL SYNC/ASYNC RECEIVER/TRANSMITTER (USART)

The 9551/8251, USART 93 (AMD and Intel) is a programmable serial data communications interface that performs a universal sync/async receiver/transmitter function. It accepts parallel data from MPU 90, forms and serializes the information based on its current operating mode.

Three USARTS are used in the FLMS processor module. They are in communication with the printer, indication board and line analyzer. FIG. 13 shows the timing and communication control logic. The 9551/8251 USART 93 is double buffered and can be operated at clock frequencies up to 4 MHz.

MEMORY

The memory for the FLMS processor module is 1 Mega bytes maximum. It includes EPROM, static RAM and dynamic RAM. The range of memory depends on the option of print format and the application for the FLMS system.

MAIL BOXES

FIG. 14 shows the FLMS mail boxes. The mail boxes are the communication media of the FLMS controller 50 and FLMS processor 51. They comprise six latches 95 (25LS373). Three of these are for controller to processor functions, the remainder are for processor to controller communication. When the controller module 50 sends mail to the processor module 51, the MPU writes (OUTPUT) data into the latches 95 which are addressed as XX13, XX14, and XX15, and then issues an interrupt request (OUTPUT to XX16) signal to the NMI input of the 8088 MPU. During that interrupt service routine, the 8088 MPU picks up the mail by reading (INPUT) data from the same latches but addressed as YY10, YY11 and YY12, and then issues an interrupt request (OUTPUT to YY17) to the controller module. The 8085 based module calls interrupt routine to check if there is any more mail to be sent or not.

When the processor module sends mail to the controller, it writes (OUTPUT) data into the latches which are addressed as YY13, YY14 and YY15, and then issues an interrupt request (OUTPUT to YY16) signal to the controller module. The 8085 MPU picks up the mail by reading (INPUT) data from the same latches but addressed as XX10, XX11 and XX12, and then issues a mail received signal (OUTPUT to XX17) to the processor module.

If a mail is ready for sending but the previous one has not been picked, this new message will be stored in the mail office until the next send mail routine is being called. The interrupt request for sending mail to the FLMS processor module is the highest priority among the rest. The interrupt for communication is the lowest priority among the interrupt routines of the FLMS controller module. Therefore, the monitoring operation of FLMS controller will not be interrupted frequently. The message normally consists of three bytes (8 bits/-byte) information. The first byte is the message-type code, the second is the least significant portion of data. The message-ID (i.e., the type code) is used by the receiver to direct the service routines. Appendix A lists the message-IDS and their definitions.

INFEED CONTROL INTERFACE LOGIC

The infeed control module 57 (FIG. 4) is controlled by applying a DC current through an air-valve solenoid. An infeed gate is synchronized with the rotating encoder of a worm feed screw 9 situated between the gate 35 and pocket feed member 13 (FIG. 1) to prevent the container from being crushed.

FIG. 15 shows the infeed control interface logic. Two timing inputs are active high signals. The switch $S_c$ is for manual closing control. The timing inputs should not be floated simultaneously when manual control is desired. The timing relations between the two timing signals are adjustable by adjusting the encoder or the location of the valve counter trigger sensor.

For example, when there are two consecutive containers for valve-34 and valve-35 to be stopped and the space constant for infeed control (i.e., a) equals 20, then when the valve counter counts to 14, the MPU finds out that the container at infeed gate is for the valve-34 (i.e., $14+a=34$) and it must be stopped. The MPU issues a CLOSE GATE command (OUTPUTS dummy to port XX30) and then the infeed control interface signal is driven high.

As seen in FIG. 16 at the rising edge of the encoder sync output, the infeed gate control signal is driven active high and the air-valve solenoid is activated. When the valve counter counts to 15, the container at the infeed gate is for valve-35 (i.e., $15+a=35$), and the MPU issues another CLOSE GATE command. When the valve counter counts to 16, the container at the infeed gate is for valve-36 (assuming it is allowed to enter), the MPU issues an OPEN GATE command (i.e., OUTPUTS dummy to port XX37). At the rising edge of the encoder sync output, the infeed gate control signal is driven low and the air-valve solenoid is inactivated.

SWITCH/DISPLAY BOARD

The switch display board 100 shown in FIG. 17 enters the operating parameters, enables the sampling procedure, reads the report, issues the print command, changes the control factors and debugs the FLMS system. The switch/display board consists of 24 functional keys 101, 12 numerical keys 102, 10 7-segment LEDs 103, and a control/interface logic.

FUNCTIONAL KEYS AND NUMERICAL KEYS

The functional keys re RESET, RESTART, FILLER SAMPLE ENABLE, SEAMER SAMPLE ENABLE, GAMMA STANDARD, SAMPLE LIST, SAMPLE PERIOD, ALL, GOOD COUNT, REJECT COUNT, SAMPLE COUNT, CONTROL CHANGE, PRINT FORMAT, PRINT LINES, PRINTER ENABLE, ALARM ACKNOWLEDGE, FILLER STATUS, FILLER FAULTY COUNT, SEAMER STATUS, SEAMER FAULTY COUNT, ID(CONTL), NUMBER(CLEAR), DEBUG and reserved. The numerical keys are 1(A), 2(B), 3(C), 4(D), 5(E), 6(F), 7, 8, 9, 0, STRING(SHIFT) and ENTER(-MORE). Appendix B lists the functional and numerical keys with their corresponding location codes, input codes, 7-segment displays, display codes, and remarks. The location code (R S) indicates the location of key. Every functional key is associated with an ID-display to indicate the recognition by the MPU. Some of the keys are dual functions, e.g., ID(CONTL) key is an ID key in normal mode and is a "CONTL" key in debug mode.

FIG. 18 is the control logic for the switch/display board. An 8279 keyboard/display controller 104 controls the scanning, fetching and displaying operations. It is programmed for interrupting the 8088 MPU whenever a key is pushed. The MPU reads the location code and performs the programmed operation. Blocks 105 and 106 are decoders, block 107 is a D-type flip-flop and blocks 108 are latches.

The dual functional keys are controlled by logic shown in FIG. 19. After the DEBUG key 109 is pushed, the switch/display board is in DEBUG mode. The STRING key is operating as SHIFT key for entering the hexidecimal data "A" through "F" by using the "1" through "6" keys. Pushing STRING key once will alter the shift or normal mode. When the numerical keys are in the shift mode, the decimal point of ID-1 display (FIG. 17) is ON.

The ID key is operating as CONTL (i.e., control) key for debugging the 8085 based system. When it is in CONTL mode, the decimal point of ID-0 display is ON and the memory of the FLMS controller module can be examined. Pushing ID key once during the DEBUG mode, it will alter the 8085 or 8088 debug mode. Whenever the ENTER is pushed, the switch/display board returns to normal mode (i.e., non-debug, non-shift and non-contl modes).

Some functional keys are required by providing data. After those were pushed, the DATA required indicator is ON (i.e., the decimal point of the least significant digits). After the data is entered, the DATA light will be OFF. When an alarm is to be set, the MPU issues an alarm set command (i.e., I/O to YY20). After the alarm acknowledge key is recognized, the MPU will reset the alarm by issuing a clear command (i.e., I/O to YY21). The two 74LS73 J-K flip-flop devices 110 act to prevent debounce scanning and the three 74LS74 D flip-flops 111 function to control the display.

IN-FEED GATE

Figure 20:
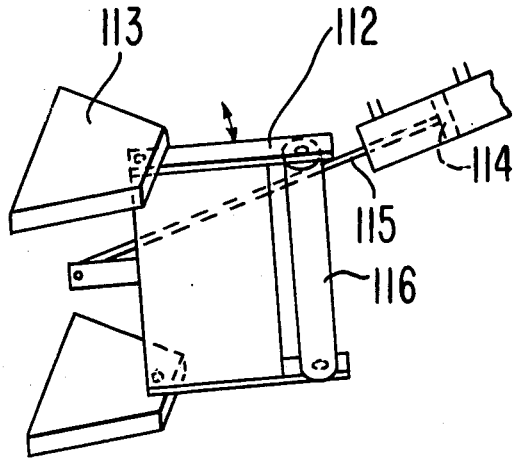
FIG. 20 is a perspective view of an in-feed gate used in the in-feed conveyor for controlling the nonentry of a container to a particular valve in the fill station or seamer position in the seamer.

FIG. 20 shows an in-feed gate utilized to interrupt or prevent the flow of a container into a fill pocket. The gate sub-system is mounted at location (A) (FIG. 1) and comprises a longitudinal-extending aperture (not shown) in a side wall of conveyor 11, and a pivoting gate 112 operable through the aperture into the flow-path of containers such as can 12*a*. Suitable bracket means 113 connects the gate to the conveyor support structure. A solenoid-operated air piston valve 114 has a piston rod 115 attached to gate 112 for actuating gate 112 into and out of the container flow path to hold up a container for a precise time period representing the spacing needed to move that container into the worm feed gear 9 (FIG. 1) and then into a particular pocket of the filler station. A rubber bumper 116 is normally rotatively affixed to gate 112 to prevent container damage.

OPERATION AND PROCEDURE

Various functions and operations are performed by the apparatus and control hardware described above. These include fill line monitoring operations, programming procedures, calibration functions, the sampling, the rejection, the real time analysis, and format-selectable reports.

The monitoring operations include inspection routines which include the fill height detections, the discharge routine, and the main routine which includes the infeed control routine. The calibration functions include the calibration routine and the synchronization-check routine.

Programming procedures include the key definition of the switch/display board and the procedures for setting up the operating modes, debugging modes or reporting modes and sampling and rejection operations.

Real time analysis routines estimate the total losses and determine the operating situations of the filler and seamer. The FLMS may also provide different formats of report, selectable and programmable by using the switch/display board.

The FLMS controller 50 monitors the container motions between the infeed gate and the leaking reject module 36 (FIG. 1). The motion between the infeed gate 35 and the discharge point (C) is synchronized with the rotating speed of the filler and seamer. The space between two containers depends on the number of pockets within this range. However, the container spacing is variable with respect to those containers between the discharge point (C) and the leaking reject module 36.

DISCHARGE POINT

When a container is discharged from the discharge point, it is assigned a block in the Container Table (Appendix C). Each block consists of an 8-bit filler valve number, a 6-bit seamer head number, a sample bit and a reject bit. The pointer-1 of the Container Table increments by one whenever a block of data is written.

When the container exists at the container discharge sensing module 19 (i.e., the Location-(C)), the 8085 MPU 70 reads the filler valve counter (V) and calculates the container-valve number ($C_v=V-k+mM$, Equation (7)). The MPU then reads the seamer head counter (H) and calculates the container-head number ($C_h=H-h+nN$, Equation (8)).

If the filler sample enable flag or the seamer sample enable flag is set (i.e., enabled), the MPU will compare the $C_v$ or $C_h$ with the sample list. If the $C_v$ or $C_h$ is in the list, the sample bit will be set to "1". For the filler line where the filling inspection module is located between the filler and the seamer, the MPU reads the reading of counter (B) and calculates the Container-filling number ($C_b$, i.e., $C_b=b-f+n'$ (256), Equation (10)). The MPU then reads the data from the reject table which is pointed by $C_b$, and sets the reject bit to "0" or "1".

The MPU writes the data of $C_v$, $C_h$, the sample bit and the reject bit into the block of the Container Table which is pointed by the pointer-1. After the writing is completed, the pointer-1 is incremented by one.

For the filler line where the filling inspection sensing module is located down stream of the seamer, the MPU sets the reject bit when the container passes through that inspection station.

CONTAINER TABLE

The container Table (Appendix C) contains the string records for those containers which are situated randomly between the discharge point and the leaking reject module 36. There are six pointers in this Table. Pointer-1 is assigned for the container discharge sensing module, it is incremented by one when a block of data is written. Pointer-2 is assigned for the filling inspection module when it is located at location (D). The pointer-2 is incremented by one when a block of data is read and its reject bit is accessed.

Pointer-3 is assigned for the sample sensing module which is located at location (E). When a block of data is read, the pointer is incremented by one. Pointer-4 is assigned for the filling reject sensing module which is located at location (F). When a block of data is read, this pointer is incremented by one.

Pointer-5 and Pointer-6 are assigned for the leaking inspection module 36 and the leaking reject module 33, respectively. Pointer-5 is incremented by one when the data of the Table is accessed. Pointer-6 is incremented by one whenever a block of data is read.

The total configured length of the Container Table is 516 bytes (8 bit/byte). The maximum number of the pointers is 255. When the number exceeds 255, the pointer starts from 0 again. After reset, restart or synchronization-check, all of the pointers are reset to zero.

For example, the containers discharged from the discharge point are in the order of ($C_v=5$, $C_h=1$), ($C_v=6$, $C_h=2$), ($C_v=7$, $C_h=3$), ($C_v=9$, $C_h=5$), ($C_v=10$, $C_h=6$), . . . . As shown in the Container Table before rejection, when the container of ($C_v=7$, $C_h=3$) passes through the sample sensing module, the pointer-3 is "2". Whenever a container is sampled or rejected, its block is being filled by all "0" to indicate that the container is no longer present. When the MPU reads an all-zero data, it will increase the pointer by one and read the next block of data. For instance, if the container of ($C_v=9$), $C_h=5$) was rejected, this is shown in the Container Table after rejection.

MAIN ROUTINE AND INFEED CONTROL

The main routine reads the filler valve number from the filler valve counter and the seamer head number from the seamer head counter consecutively. Whenever the number is changed, it calculates the container-number at infeed gate (i.e., $A_v=V+a-mM$ and $A_h=H+b-nN$, Equation (5 and 6), compares with the infeed control interface logic.

The main routine is interruptable. The maximum of eight interrupts will occur during the interval of 25 ms (e.g., 2400 container/min). Therefore, the average timing for each interrupt service is about 2500 microseconds. The example, when the FLMS controller is running at 4 MHz, the 2500 micro-second is equivalent to 10,000 MPU clocks and equivalent to about 1,000 instructions. This indicates that the FLMS controller can monitor the filler line at the speed of 2400 containers/minute.

For the filler line without infeed gate, the main routine is the same as that with infeed gate. For the filler line with infeed gate, the space constants (a and b) are calibrated during RESET or RESTART procedure.

Appendix D shows Infeed Tables for the filler and seamer which are used to indicate if a particular valve or seamer pocket is "good" or "bad".

FILL-HEIGHT DETECTION

The Gamma-101, 102 fill-height detection module is presettable for detecting one or two conditions only. It can be set for inspecting the underfill, the overfill, the missing-cap or the high-cap condition.

When a container passes through the filling or leaking inspection sensing modules 25 and 36, the RST7.5 or IREQ1 interrupt input (FIG. 6) is activated, and the 8085 MPU 70 executes the inspection routine. It reads the data from the inspection module. The data include the decision on reject and the condition. The FLMS controller records the decision in the Container Table or in the Reject Table. Then, it reports the valve number and result or the head number and result to the FLMS processor.

FILL-AMOUNT DETECTION

The fill-amount detection module Gamma-201 provides the number of Gamma radiation counts only. The FLMS reads this data and compares with a pre-programmed Gamma Standard Table to decide the rejection. The reject level is entered through the switch/display board when the rejection level is being changed. The standard level change for the Gamma-101 module is adjusted by numerical dials located at the Gamma-101 control board. The Gamma-201 module, unlike the -101 module which detects only if the standard is met, can inspect different conditions such as low fill, high fill and quantities. The FLMS system may provide a complex report for analysis.

A filler valve table and a seamer head table used with the FLMS processor are shown in Appendix E. Counts of faulty containers are updated whenever underfilling, overfilling or leaking of a container is detected.

The switch/display board provides means to change the operation mode, the parameters, the inspection standard, the print format, and the control factors. It also provides means to debug the FLMS system and to examine and update the memory.

SWITCH DEFINITIONS

Functions of the switch/display panel (shown in FIG. 17) with the location of the key indicated in parenthesis and the display indicated in quotes are:

ALARM ACKNOWLEDGE (44) "AA": To reset the alarm. The FLMS processor will turn the alarm in any mode.

ALL (42) "AL": To issue the request for sampling a set of containers, which are filled by every valve or sealed by every head. The "FILLER SAMPLE ENABLE" or "SEAMER SAMPLE ENABLE" key must follow this key. It also activates the printing routine to print the whole list.

CONTROL CHANGE (43) "CC": To change the infeed control bit of the filler status or the seamer status, also used to abort the print routine or the sampling routine.

DEBUG (36) "db": To enter the debug mode. For the 8088 based module, the "CONTL" indicator is OFF. It is ON for debugging the 8085 based module. The indicator is controlled by "ID" key.

ENTER (83) "none": To enter the data shown at the display. After this key was pushed, the "Data" indicator will be OFF.

FILLER FAULTY COUNT (25) "FF": To display the total faulty count of the filler. If a valve number is entered, the faulty count of the selected valve will be displayed.

FILLER-SAMPLE ENABLE (31) "FE": To enable the sampling routine. The sample list must be set up prior to this key for sampling a set of specified containers. This also works with "SAMPLE ALL" and "SAMPLE LIST" keys to specify the sample-all-request or sample-list for the filler or seamer.

FILLER STATUS (15) "FS": To display the total number of filler samples which has been ejected. After a valve number is entered, the status of the selected valve will be displayed.

GAMMA STANDARD (12) "GS": To set up the Inspection Standard Table.

GOOD COUNT (13) "GC": To display the total number of containers which can be accepted.

ID(CONTL) (16) "Id": To enter the ID code for expanding the feature, or to exit from the on-going mode. In the debug mode, this key is equivalent to "CONTL" key to selecting the target system to be debugged.

NUMBER(CLEAR) (26) "bbbbbbbb": To clear the number display to all blanks (b in normal mode). To enter data after the ID key was pushed. In debug mode, the NUMBER key affects the two least significant digits only.

PRINTER ENABLE (34) "PE": To enable the printer routine. This key is only recognized in the modes which the data or printing information are provided. The Print Format and Print Line are required to be pre-programmed prior this key.

PRINT FORMAT (14) "PF": To select the print format prior to the PRINTER ENABLE Key. The preselected format code will be displayed. To change to format, the number keys and ENTER are used.

PRINT LINE (24) "PL": To specify the number of lines to be printed prior to the PRINTER ENABLE key. The pre-programmed number will be displayed.

REJECT COUNT (23) "rC": To display the total number of rejected containers.

RESET (11) "rS": To reset the FLMS controller and the FLMS processor. The memory of those two modules will be cleared.

RESTART (21) "rr": To restart the FLMS controller. The pointers for each table are reset to their initial values. The programmable parameters will not be altered.

SAMPLE COUNT (33) "SC": To display the total number of samples.

SAMPLE LIST (22) "SL": To create a new sample list. If the "FILLER SAMPLE ENABLE" or "SEAMER SAMPLE ENABLE" key follows, the MPU will display the programmed list at the number display. In case of more data to be displayed, the last digit will be "1-". Another "FILLER SAMPLE ENABLE" or "SEAMER SAMPLE ENABLE" will enable the MPU to display more sample list. The range of list cannot exceed the maximum limitation of containers for the area between the discharge point (C) and the sampling module 26 (FIG. 1).

SAMPLE PERIOD (32) "SP": To display or update the period for sampling. For displaying, the "FILLER SAMPLE ENABLE" or "SEAMER SAMPLE ENABLE" key must follow this key. For updating, the numerical data is required. The unit is in minutes. The "FILLER SAMPLE ENABLE" or "SEAMER SAMPLE ENABLE" is used to specify the type of sample and enter the data.

SEAMER FAULTY COUNT (45) "SF": To display the total number of seamer faulty count. If numerical data is entered, the MPU will display the faulty count of the selected head.

SEAMER SAMPLE ENABLE (41) "SE": To enable the seamer sampling routine. The sample list must be set up or the SAMPLE ALL must be pushed prior to enable the sampling routine. This key also works with "SAMPLE PERIOD" and "SAMPLE LIST" keys.

SEAMER STATUS (35) "SS": To display the total sample number of seamer. After a head number is entered, the status of the selected seamer head will be displayed.

STRING (81) "-": This key is used for entering a string of samples when creating the sample list. In the debug mode, this key is equivalent to "SHIFT" key for entering the hexadecimal data.

1(A) (51) "1 or A": This is "1" in the normal mode. In debug mode, it is "1" when "SHIFT" is OFF and it is "A" when the indicator ON.

2(B) (52) "2 or B": This key is "2" in the normal mode. In debug mode, it is "2" or "A" depending on that the "SHIFT" indicator is OFF or ON.

3(C) (53) "3 or C": This is "3" in normal mode. In debug mode, this key is "3" when the "SHIFT" indicator is OFF and it is "C" when the indicator is ON.

4(D) (61) "4 or D": This is "4" in normal mode. In debug mode, it is "4" or "D" depending on whether the "SHIFT" is OFF or ON.

5(E) (62) "5 or E": This is "5" in normal mode. In debug mode, it is "5" or "E" depending on whether the SHIFT" indicator is OFF or ON.

6(F) (63) "6 or F": This is "6" in normal mode. In debug mode, it is "6" or "F" depending on whether the "SHIFT" indicator is OFF or ON.

7 (71) "7": This is "7" in all modes.

8 (72) "8": This is "8" in all modes.

9 (73) "9": This is "9" in all modes.

0 (82) "0": This is "0" in all modes.

DISPLAY DEFINITIONS

ID: The ID-display consists of two 7-segment LEDs located at the leftmost corner. It indicates which functional key was selected.

NUMBER: The number-display consists of eight 7-segment LEDs located at the right side of the ID-display. It indicates the data, memory location, status and list.

SHIFT: This indicator is the decimal point of the ID-1 display on the panel. It is affected by the "STRING" key during the debug mode.

CONTL: This indicator is used in debug mode to identify that the debug procedure for the 8085 based system is under testing. It is the decimal point of the ID-0 display.

DATA: This indicator is the decimal point of the least significant digit of the number display. It is ON when the data is required for the selected function.

"I.g.n.o.r.E.d.": This is displayed at the number display when an illegal key was pushed or an illegal datum was entered.

"8-": When the "-" follows a number, it indicates the next data will be the ending of the string. This is affected by STRING key in the list mode.

"12Ƀ": When the "Ƀ" follows a number it indicates that the number has been entered and it is not the starting of a string.

"1-": The "1-" indicates that more members of the list are to be displayed.

"-1": The "-1" indicates the end of list.

"F": When an "F"is displayed at the least significant digit and follows at least a "-", it indicates that datum or function is for the filler only.

"S": When an "S" is displayed at the least significant digit and follows at least one "-", it indicates that the datum or function is for the seamer only.

"U": When a "U" is displayed at the location of Digit-4 for the Status display, the number at the left side of "U" indicates the filler valve number and the number at the right side is the status (binary). D-0: No Container, D-1: Sample, D-2: reserved, D-3: reserved.

"H": Same as "U" but for the seamer head.

"1·1": This is displayed at D-2 in debug mode to separate the 8088 location and the data.

"1.1": This is displayed at D-2 in debug mode to separate the 9085 location and the data.

"UF", "OF": Underfill level and Overfill Level for rejection.

PROGRAMMABLE PARAMETERS

The programmable parameters are the date, time, product code, hours-per-shift, loss-ratio-limit, size of filler, size of seamer, distance from discharge point to last reject module, distance between discharge point and sample sensing module, diameter of container, etc.

Each parameter is associated with an ID code, which is described in Appendix F. The default values are preprogrammed in EPROM. During initialization, the MPU moves those data to RAM. To enter the parameters, and uses ID and numerical keys to create the ID code first, then uses the NUMBER and numerical keys to enter the data.

(EXAMPLE) to enter the date of July 20, 1982:

| KEY | DISPLAY | |
|---|---|---|
| ID | Id | ƀƀƀƀƀƀƀƀ. |
| 99 | Id | 99. |
| NUMBER (or ENTER) | 00 | . |
| 072082 | 99 | 72082. |
| ENTER | 99 | 7-20-82 |

(EXAMPLE) To enter the product code of 4089643:

| KEY | DISPLAY | |
|---|---|---|
| ID | Id | ƀƀƀƀƀƀƀƀ |
| 97 | Id | 97. |
| NUMBER | 97 | . |
| 4089643 | 97 | 4089643. |
| ENTER | 97 | 4089643 |

(EXAMPLE) To enter the loss-ratio-limit of 0.02% (i.e., 20%/1000):

| KEY | DISPLAY | |
|---|---|---|
| ID | Id | ƀƀƀƀƀƀƀƀ. |
| 95 | Id | 95. |
| ENTER | 95 | . |
| 2 | 95 | 20. |
| ENTER | 95 | 0.02 |

(EXAMPLE) To enter the container diameter of 5 inches:

| KEY | DISPLAY | |
|---|---|---|
| ID | Id | ƀƀƀƀƀƀƀƀ. |
| 92 | Id | 92. |
| NUMBER | 92 | . |
| 500 | 92 | 500. |
| ENTER | 92 | 5.00 |

PRINT PROCEDURE

To print the data on the printer, the PRINTER ENABLE key is used. The display must be showing a valid ID code. The valid ID codes are:

PF—PRINT FORMAT with valid format code.

PL—PRINT LINE with valid number.

SC—SAMPLE COUNT with total number of samples.

rC—REJECT COUNT with total number of rejected containers.

SL—SAMPLE LIST with any portion of the list, the whole list will be printed.

GS—GAMMA STANDARD with valid level-code or SA-code.

GC—GOOD COUNT with total number of good containers.

SS—SEAMER STATUS with total number of seamer samples, or with valid seamer head number, or with "0" seamer head number for printing whole status of each head.

FS—FILLER STATUS, same as "SS".

SF—SEAMER FAULTY COUNT with total number of seamer reject containers, or with a valid seamer head number, or with "0" seamer head number for printing whole faulty counts of each head.

FF—FILLER FAULTY COUNT, same as "SF".

db—DEBUG with a valid memory location, the printer will print a set of data, defined by PRINT LINE.

INSPECTION STANDARD TABLE

The Inspection Standard Table is an inspection reference to determine the filling conditions of the container. It is the reading levels of the fill-amount inspection module. The MPU reads the datum from module and compares it with the Inspection Standard Table. The MPU then determines the amount of the contents in the container. The Standard Table can be set up by entering the reference values through the switch/display board or established by running two or more standard containers through the inspection module when the FLMS is ready for fetching the reference data.

To set up the standard table by using the switch/display the GAMMA, STANDARD, GOOD COUNT, REJECT COUNT, STRING, ENTER and numerical keys are used. The procedure is described as follows:

Standard Table Display:

GAMMA STANDARD—underfill-level amount is shown at display. If the amount has to be changed, see Standard Table Update.

STRING: the next-level amount is shown at display.

Standard Table Update:

GAMMA STANDARD and STRING—until the level to be changed is shown at display.

NUMBER—the previous amount will be cleared, but the level number is still shown on the display. The data indicator is ON.

Numerical data and ENTER—The data indicator turns OFF.

STRING—to display more levels.

Standard Table Listing:

(1) GAMMA STANDARD
(2) All
(3) PRINTER ENABLE

The display sequence of the Gamma Standard is:

(1) Under-Fill (UF)
(2) Over-Fill (OF)
(3) Air Only (Ar)
(4) Level-3 (L3)
(5) Level-4 (L4)
(6) Level-5 (L5)

To establish a standard table by running two or more standard containers, which are pre-measured, through the fill amount inspection module, the programmable parameter ID-89 is used. The procedure is:

(a) "ID"
(b) 89
(c) "NUMBER:
(d) level-code
(e) "ENTER".

After the level-code is entered, the display will show the level code at ID display, it indicates that the FLMS is ready to fetch the reading of the inspection module. Whenever the data is fetched, the reading will be displayed at the numerical display. The FLMS is ready for the next procedure.

The level-codes are defined as: 0—Air only; 1—Under-Fill; 2—Over-Fill; 3 thru 9—Different standard references.

(EXAMPLE) To establish the Overfill Standard Level by using the standard container:

| KEY | DISPLAY | |
|---|---|---|
| ID | Id | ЬЬЬЬЬЬЬЬ. |
| 89 | Id | 89. |
| NUMBER | 89 | . |
| 2 | 89 | 2. |
| ENTER | L2 | . |

The FLMS is ready for fetching the inspection module reading (e.g., 230). Then, the display is:

| | |
|---|---|
| L2 | 230 |

(EXAMPLE) To print the established standard table:

| KEY | DISPLAY | |
|---|---|---|
| ID 89 | Id | 89. |
| ALL | 89 | AL. |
| PRINTER ENABLE | PE | 10 |

CREATING SAMPLE LIST

To create a Sample List for the filler, the following keys are used.

SAMPLE LIST;
Numerical keys, include ENTER and STRING keys;
FILLER SAMPLE ENABLE.

To create a Sample List for the seamer, the following keys are used.

SAMPLE LIST;
Numerical keys, include ENTER and STRING keys;
SEAMER SAMPLE ENABLE.

(EXAMPLE—1) To create a Sample List for the filler valves from "1" through 24.

| KEY | DISPLAY | |
|---|---|---|
| SAMPLE LIST | SL | ЬЬЬЬЬЬЬЬ. |
| 1 | SL | 1. |
| STRING | SL | 1-. |
| 24 | SL | 1-24. |
| FILLER SAMPLE ENABLE | SL | 1-24U |

(EXAMPLE—2) To create a sample list for the seamer heads, 2, 5, 6, 7, and 10.

| KEY | DISPLAY | |
|---|---|---|
| SAMPLE LIST | SL | ЬЬЬЬЬЬЬЬ. |
| 2 | SL | 2. |
| ENTER | SL | 2 . |
| 5 | SL | 2 5. |
| STRING | SL | 2 5-. |
| 7 | SL | 2 5-7. |
| ENTER | SL | 2 5-7 . |
| 10 | SL | 2 5-7 10. |
| SEAMER SAMPLE ENABLE | SL | 2-7 10H |

Note that the sampling routine does not activate at this step. To activate the sampling routine, the FILLER SAMPLE ENABLE key or the SEAMER SAMPLE ENABLE key are pushed.

CREATING SAMPLE PERIOD

To create a period for sampling, the following keys are used.

SAMPLE PERIOD;
Numerical keys, the datum unit is minutes;
FILLER VALVE ENABLE or SEAMER SAMPLE ENABLE.

The sampling routine will be activated once every period of time.

(EXAMPLE) To program the FLMS to eject a sample set every 20 minutes, i.e., one from each fill valve.

| KEY | DISPLAY | |
|---|---|---|
| SAMPLE PERIOD | SP | ƀƀƀƀƀƀƀƀ. |
| 20 | SP | 20. |
| FILLER SAMPLE ENABLE | SP | 20U |

(EXAMPLE) To program the FLMS to eject a whole set of seamer sample every 15 minutes, i.e., one from each seamer station.

| KEY | DISPLAY | |
|---|---|---|
| SAMPLE LIST | SL | ƀƀƀƀƀƀƀƀ. |
| 1 | SL | 1. |
| STRING | SL | 1-. |
| 12 | SL | 1-12 |
| SEAMER SAMPLE ENABLE | SL | 1-12H |
| SAMPLE PERIOD | SP | . |
| 15 | SP | 15. |
| SEAMER SAMPLE ENABLE | SP | 15H |
| or SAMPLE PERIOD | SP | ƀƀƀƀƀƀƀƀ. |
| 20 | SP | 20. |
| ALL | SP | 20A. |
| SEAMER SAMPLE ENABLE | SP | 20ASE |

(EXAMPLE) To request two sets of a whole sample of filler.

| KEY | DISPLAY | |
|---|---|---|
| SAMPLE ALL | SA | ƀƀƀƀƀƀƀƀ. |
| 2 | SA | 2. |
| FILLER SAMPLE ENABLE | SA | 2UE. |

DISPLAY AND PRINT REQUEST

The Filler status, Seamer status, Filler Faulty count, Seamer Faulty count, Good count, Reject count, Sample count, Sample List, Sample Period, Gamma Standard and Printing line can be displayed at the LED display. Those data also can be printed upon request.

SETTING REJECT OPERATION

The eject stations are programmable for ten levels and two conditions. The user can select any eject station to eject the container which inspection reading is greater or less than the pre-selected level. To program the eject operation, the ID-85 is used. The programming procedure and format are described as follows:

| | |
|---|---|
| PROCEDURE: | (1) ID |
| | (2) 85 |
| | (3) NUMBBER |
| | (4) Eject Station--Number (1 digit) |
| | (5) Greater or Less than (0 or 1) |
| | (6) Reference level (1 digit) |
| | (7) ENTER |
| FORMAT: | 8 5 ƀ ƀ ƀ ƀ n n n |
| | Reference level (0,1, ..., 9) |
| | Greater/Less than (0/1) |
| | Eject Station-# (1,2, ..., 9) |

Note:
Reference level-0 = Air only level
Reference level-1 = Under-Fill level
Reference level-2 = Over-Fill level The default set up for FLMS is programmed as follows (it can be changed per request):

Eject Station-#2: Greater than under-fill level, i.e., UF reject.

Eject Station-#3: Greater than under-fill level, i.e. leaking reject.

(EXAMPLE) To set up the Eject Station-#2 for over-fill reject.

| KEY | DISPLAY | |
|---|---|---|
| ID 85 | 85 | ƀƀƀƀƀ101 |
| NUMBER | 85 | . |
| 2 (i.e., Station-#2) | 85 | 2. |
| 1 (i.e., less than) | 85 | 21. |
| 2(i.e., Over-Fill level) | 85 | 212. |
| ENTER | 85 | 212 |

The Eject Station-#2 will reject the container when inspection reading is less than the OF level.

CALIBRATION

The FLMS controller is designed to monitor the filler line by means of the number of pockets between two sensing modules. The space constants are very important for tracing the valve number and seamer number. See Equations (5) through (10) for details.

When the EPROM is burned, i.e., permanently set, the spacing constants are provided for the user or field engineer. During initialization routine, the pre-programmed constants are moved into the working-storage memory. If the sensing modules' locations have been altered, the actual space constants may not be equal to the pre-programmed values. The FLMS controller is designed to calibrate the space constants whenever 5 or more containers are missing consecutively.

The pointers of the Container Table are the tools for tracing the valve number and the head number. Those pointers are calibrated whenever "q" or more containers are missing consecutively. The value of "q" is the maximum number of containers existing between the discharge point and the last sensing module. It is calculated by FLMS processor from the following equation.

$$q = \frac{\text{Distance between the discharge point and the last module}}{\text{Diameter of Container}} \quad (21)$$

The distance and diameter are pre-programmed and re-programmable, i.e., ID=96 and 98 (the default values are 40 ft and 2.5 inches, $q40\times12/2.5=192$).

For example, if seven containers are missing and distributed at valve-11 through 17, the counter #1 (see FIG. 8) will count down to zero when the valve-15 passes through the Filler Valve Sensing module. The RC of COUNTER #1 presets the D Flip-flop of B—B logic. When the container at valve-18 passes through teh sensing module, the output of the Filler Valve counter (V) is latched, i.e., VX=18. The counters #2 and #5 are enabled. When the container of Valve-18 passes through the filling inspection sensing module 23 at Location (B), the reading of counter B is latche (e.g., BX=48). When the container of valve-18 passes through the seamer head sensing module 24, the reading of seamer head counter (H) is latched (e.g., HX=8). Whenever the container of valve-18 passes through the discharge point (C), the RST5.5 interrupt is requested.

The 8085 MPU reads the output of counters V, B, and H (e.g., V=116, B=79 and H=5) and calculates the space constants k, h, and f (see Equations 17, 18, and 20). The values are:

$$k=V-VX+mM=116-18+0\times144=98$$

$$h=H-HX+nN=5-8+1\times12=9$$

$$f=B\ BX+n'(256)=79-48+0=31$$

After RESET, the infeed gate is closed for at least three revolutions of the filler. When the valve counter (V) counts to 1, the MPU issues an OPEN command to Infeed Control Interface logic. Then, the MPU issues a CLOSE command when Valve Counter counts to 2. When the first container passes through the Filler Valve Sensing module, i.e., IRQ7 being activated, the 8085 MPU reads the output of the valve counter (e.g., V=21). The output of the counter is also latched (VX=21). The space constant of infeed gate i.e., a, Equation (5) is $$a=V-1+mM=21-1+0=20.$$

If IRQ7 routine has not been activated when another V=1 occurs, the Infeed Gate will be OPEN for V=1 and then CLOSED. After the IRQ7 has been activated, the Infeed Gate will be operated normally.

When the first container passes through the filling inspection sensing module 23 located at (B), the MPU reads the output of the valve counter (V=106) and the VX. The space constant of valve-to-B (i.e., g, Equation (19) is $$g=V-VX+mM=106-21+0=85$$

The space constant of the infeed-to-head i.e., b, Equation (6) can be calculated by following equation.

$$b = a + k - h \pm nN$$

$$= 20 + 98 - 9 - 9 \times 12 + 1$$

Therefore, when a container exists at the infeed gate and the seamer head counter is 6, the container will be sealed by head-7 (i.e., H+b−nN). For a filler line without the infeed gate, the constants "a" and "b" are ignored.

SAMPLING AND REJECTION

The filler line with one or more ejectors can work with the FLMS system to achieve automatic sampling and automatic sampled can rejection at a Location (E) (FIG. 1) by sample sensing module 26. The user can enable the sampling procedure by pushing the switches of the switch/display board.

The ongoing sampling or rejection can be aborted by the CONTROL CHANGE switch when the switch-/display board is displaying the sampling or ejection mode. The sampling routine, rejection routines, and the infeed gate control routine can be disabled by ID and its parameter.

SAMPLING OPERATION

There are four flags for sampling operation.

Filler Sample Enable (FSE)—indicates that the FILLER SAMPLE ENABLE key of the switch/display board is pushed in proper modes or the sampling period is reached. This flag is set or reset by the FLMS processor. It can be reset by the FLMS controller when the sampling operation is completed.

Seamer Sample Enable (SSE)—indicates that the Seamer SAMPLE ENABLE key is pushed in proper modes or the sampling period is reached. It can be set or reset by the FLMS Processor and be reset by the FLMS controller when the sampling operation is completed.

Ejector Enable (EJE)—indicates that the ejector for sampling is enabled. It is set by the all-one word (FFFF) in the Container Table when it was cleared. It is cleared by the all-one word when it was set. When this flag is set and the sampling bit of the container is set, the ejector of the sampling module is activated and a container such as can 12g is moved to sample conveyor 27.

Endless (EDL)—indicates that the sample set is not completely existing between the discharge point and the sampling module. The incomplete sample set will be ignored. This flag is set when the Leading word (FF00) arrives at the sampling module.

Whenever a container is discharged from the discharge point (C), if one of the sample enable flags (FSE and SSE) is set, the 8085 MPU will read the number from the sample list (Appendix G) which is pointed by the Sample List Pointer (SLP). Then, the MPU compares this number with the $C_v$ or $C_h$ of the container. If they are equal, the sampling bit of the container is set. If the Sample List Pointer (SLP) is zero, the MPU will write a leading word (FF00) prior to the container's word in the Container Table. Whenever the content of the Sample List equal to "FF" (i.e., the end of the list). An all-one is loaded following the container's word of the last sample in the list. The previous leading word (FF00) is changed to all-one word.

If the container number $C_v$ or $C_h$ is less than the value of the Sample List which is pointed by SLP (i.e., the container for this number is not present), the previous leading word is changed to the missing word (00FF) and the SLP is reset to zero. For example, the container stream consists of those for Valve-10, 11, 12, 13, 14, 15, 16, 17, 18, 21, . . . . (a) If the sample list is: 12, 13, 14, 15, 18, 19, the sampling for this revolution is aborted (since #19 missing). (b) If the sample list is: 12, 13, 14, 15, 18, 21, the sample set is completed and EJE will be set.

When a whole set of samples is found, the number of sets is decreased by one. Whenever this number equals to zero, the Sample Enable flags (FSE and SSE) are cleared.

The range of the Sample List is limited by the maximum number of containers which can be distributed between the discharge point to the sampling module. For example, the distance from discharge point to sampling module is 20 feet and the container diameter is 2.5 inches, the maximum number of containers within this area is:

$$20\times12/2.5=96$$

Therefore, if the first sample is for valve-1, the last allowable sample is for valve-96. if the first one is for valve-21, the last allowable one is for valve-116. If more than 96 valves are to be sampled, the Sample All function is suggested. The ID-87 control disable parameter-"5" is another solution.

Normally, the sampling procedures select the sample from one revolution. Whenever one or more containers which are to be sampled are missing, the sampling procedure will be aborted and restarted at the next revolution. After the ID-87 parameter-"5" is issued, the sampling procedures are no longer limited by one revolution. If there are any missing containers, the selected sample will be ejected. The rest will be selected from the next revolution and lead by the container $C_v$ to $C_h$ which was missing during the previous revolution. The Sample-all function selects the sample from one or more revolutions. When sampling procedures are activated, the infeed control logic is inactivated. Whenever a sample is ejected, the container's word in the Container Table is changed to the missing word (00FF).

REJECTION

The MPU will issue an eject command to the ejector if a container's reject bit is set. The reject bit is set or cleared by the inspection module. If the inspection module is located downstream, the position beyond Location (C), the reject bit is cleared at the discharge point and set at the inspection module for the disqualifying container.

If the inspection module is located between the filler 14 and seamer 7, a Reject Table is updated whenever a container passes through the inspection module. The writing pointer indicates the value of the counter "B" and the value of reading pointer is the $C_b$, Equation (10). Whenever a container discharges from the discharge point, the reject bit in the Reject Table are transferred to the Reject bit of the Container Table.

Appendix H shows a Reject Table for inspection module-"B" and the sample list configuration.

The rejection operations can be aborted or disabled by means of ID-87 parameters.

Whenever a container is rejected, the container's word on the Container Table is changed to the missing word (00FF). When MPU reads the Container Table and finds out it is "FFFF" (all-one), "FF00" (leading or "00FF" (missing), the MPU will set/clear the EJE flag, set the EDL flag or ignored, and then reads the next word for $C_v$, $C_h$, and the sample and reject bits.

CONTROL ABORTIONS

There are two ways to abort the control operations.

Momentary abortion: this is to abort the on-going routine (e.g., sampling or printing).

Permanent disable: this is to disable the specific function (e.g., infeed control or rejection).

MOMENTARY ABORTION

To abort an on-going routine or activated routine, the CONTROL CHANGE key of the switch/display board is used. It is effective only when the switch/display is in control enable modes (i.e., Print Enable "PE", Filler Sample Enable "FE" and Seamer Sample Enable "SE").

(EXAMPLE) To abort the on-going print routine when ID display is showing "PE".

| KEY | | DISPLAY |
|---|---|---|
| PRINTER ENABLE | PE | ƀƀPL-100 |
| CONTROL CHANGE | CC | PE |

(EXAMPLE) To abort the on-going Print routing when ID display is not showing the print routine on the printer.

| KEY | | DISPLAY |
|---|---|---|
| — | — | |
| FS | FS | 2006. |
| PRINTER ENABLE | PE | 2006-FS |

Since the previous printing routine is still on the printer, this recent print routine is put on queue.

Pushing the CONTROL CHANGE key at this moment will abort the last request (i.e., PE 2006-FS) only. To abort the print routine on the printer, push PRINTER ENABLE once more and the ID display will show "PE" and the number of lines to be printed.

| KEY | | DISPLAY | |
|---|---|---|---|
| PRINTER ENABLE | PE | ƀƀƀPL-70 | |
| CONTROL CHANGE | CC | PE | |
| — | FF | ƀƀƀƀ1025 | |
| ID | Id | ƀƀƀƀƀƀƀƀ. | |
| PRINTER ENABLE | PE | ƀƀƀƀPL18 | (On Printer) |
| PRINTER ENABLE | PE | 2006-FS | (on queue) |
| CONTROL CHANGE | CC | PE | |

The print routine on the printer is not altered.

(EXAMPLE) To abort the activated sampling routine.

| KEY | | DISPLAY |
|---|---|---|
| — | GC | ƀƀƀ13245 |
| ID | Id | ƀƀƀƀƀƀƀƀ. |
| CONTROL CHANGE | CC | Id. |
| FILLER SAMPLE ENABLE | CC | FE |
| SEAMER SAMPLE ENABLE | CC | SE |
| ID | Id | ƀƀƀƀƀƀƀƀ. |

(EXAMPLE) To abort the Close Infeed Gate command.

| KEY | | DISPLAY |
|---|---|---|
| — | — | |
| ID | Id | ƀƀƀƀƀƀƀƀ. |
| 86 RETURN | 86 | CLOSE-4 |
| CONTROL CHANGE | CC | 86 |

DISABLEMENT

The eject functions of sampling and rejection can be disabled by the Programmable Parameter ID-87. The infeed gate can be closed by ID-86 for a specific number of the revolutions of the filler.

The parameter for ID-87 is an eight-digit number. Each digit indicates one of the rejection routines. 1: Sampling, 2: Underfill rejection, 3: Overfill rejection, 4: Leaking rejection, 5: Sample limitation.

(EXAMPLE) To disable the Overfill Rejection routine.

| KEY | | DISPLAY |
|---|---|---|
| ID | Id | ƀƀƀƀƀƀƀƀ. |
| 87 | Id | 87. |
| NUMBER | 87 | 0. |
| 3 | 87 | 3. |
| ENTER | 87 | 3 |

(EXAMPLE) To disable the rejection routines for the Sampling, Overfill, Underfill and Leaking.

| KEY | DISPLAY | |
|---|---|---|
| ID | Id | ƀƀƀƀƀƀƀƀ. |
| 87 | Id | 87. |
| NUMBER | 87 | 3. |
| 4321 | 87 | 4321. |
| ENTER | 87 | 4321 |

(EXAMPLE) To enable the rejection routine for the sampling after it was disabled.

| KEY | DISPLAY | |
|---|---|---|
| ID | Id | ƀƀƀƀƀƀƀƀ. |
| 87 | Id | 87. |
| NUMBER | 87 | 4321. |
| 432 ENTER | 87 | 432 |

Normally, the sample is selected from one revolution of the filler station. When the sample list is greater than the space limitation (i.e., the maximum number of containers which can be distributed between the discharge point (C) and the sample sensing module 26), the FLMS processor will ignore the valve numbers which excess the limitation and display "I.g.n.o.r.E.d." when the operator attempts to enter this valve number into the list.

To provide a sample list whose range is greater than the limitation of the set up, the space limitation may be disabled by using ID-87 Parameter-"5". This disablement allows the samples to be selected from different revolutions of the filler station.

(EXAMPLE) Setting the distance from the discharge point to the sampling module as 24 feet and the container diameter as 2.5 inches, the space limitation is:

$$24 \times 12/2.5 = 115$$

The first sample is for valve-1. When the operator attempts to program the sample for valve-118:

| KEY | DISPLAY | |
|---|---|---|
| 118 | SL | ƀ101ƀ118. |
| ENTER | SL | I.g.n.o.r.E.d. |
| ID 87 | Id | 87. |
| NUMBER | 87 | 4321. |
| 23145 | 87 | 23145. |
| ENTER | 87 | 23145. |

The parameter for ID-86 is the number of revolutions when the infeed gate is to be closed. For permanent close, the parameter is greater than 9999. The action is activated whenever the data is entered.

(EXAMPLE) To close the infeed gate for 20 revolutions of the filler.

| KEY | DISPLAY | |
|---|---|---|
| ID | Id | ƀƀƀƀƀƀƀƀ. |
| 86 | Id | 86. |
| NUMBER | 86 | 0. |
| 20 | 86 | 20. |
| ENTER | 86 | 20 |

The infeed gate to be closed when first valve-1 container exist.

(EXAMPLE) To close the infeed gate permanently.

| KEY | DISPLAY | |
|---|---|---|
| ID | Id | ƀƀƀƀƀƀƀƀ. |
| 86 | Id | 86. |
| NUMBER | 86 | 20. |
| 10001 | 86 | 10001. |
| ENTER | 86 | CLOSEd |

(EXAMPLE) To open the infeed gate when ID-86 command is displayed.

| KEY | DISPLAY | |
|---|---|---|
| — | 86 | ƀƀCLOSEd |
| CONTROL CHANGE | CC | OPEn |
| or — | — | |
| ID | Id | |
| 86 | Id | 86. |
| NUMBER | 86 | 10001. |
| 0 | 86 | 0. |
| ENTER | 86 | 0 |

FORMAT-SELECTABLE REPORTS

There are several modules of the Format-selected Reports.

Basic module: Reports the faulty valve number or the faulty head number whenever it is detected. The data is printed per request or auto-enabled. For auto-enable mode, the faulty valve or head numbers are printed when a revolution of the filler is complete.

Complex module: Reports the faulty event whenever it is detected. The data is printed per request or auto-enabled. For auto-enable mode, the data is printed per revolution or per minute. Two or more report formats are available. The operating history, analysis results and statistic diagrams may be provided. The report module may be programmed in the EPROM.

SOFTWARE DESCRIPTION

The basic software for the components of the FLMS are: main routine, calibration routines, discharge routine, inspection routine, sample routine, reject routine and communication routines.

The main routine initializes all the 8085 system's data structure and enters into endless loop with interrupt enable. The CALIBRATION ROUTINE is often used in such factors or pointers calibration. A "container existing" signal (from a seamer) causes the DISCHARGE ROUTINE to be invoked. This routine, when executed, causes a Container Table entry to be updated. The INSPECTION ROUTINE contains two basic types of inspection: filling and leaking. The SAMPLE ROUTINE and REJECT ROUTINE are designed to control ejecting operations for sampling and rejecting respectively. The COMMUNICATION ROUTINES were designed to handle communication between the two microprocessors.

MAIN ROUTINE

This routine shwon in Appendix I starts from the system initializations to the endless loop with interrupts enabled. The primary job of the main routine is to predicate valve number and seamer head number of an infeed container and to control the infeed gate.

The functions of system initializations are listed as follows:

Step 1: disables the 8085 interrupt mechanism.
Step 2: closes the infeed gate.
Step 3: programs the Am9519 interrupt controller and masks interrupt mask register if necessary.
Step 4: masks all the RST interupts of the 8085.
Step 5: bootstraps the Gamma inspection station routines.
Step 6: initializes all the system data structures.
Step 7: empties the conveyor line.
Step 8: clears all the interrupt masks except IRQ7 which is a factor of (sensor-1 factor) calibration.

The function of endless loop is to control the infeed gate according to the no-container (no-can) bit in the infeed control table. There are two infeed control tables, namely a filler infeed control table and a seamer infeed control table (Appendix D).

The way of interrupts acknowledge that the 8085 interrupt is enabled before entering the endless loop. Therefore, the endless loop can accept any possible request.

CALIBRATION ROUTINES

There are three calibration routines as shown in Appendix J—RST55, IRQ7 and TRAP.

RST55 interrupt routine: This interrupt occurs whenever there are q-missing containers at Location (C) (when a container exists from seamer 17).

VX: when the container passes through the valve sensor.
Hx: when the container passes through the head sensor.
Bx: when the container passes through the point B sensor.

This routine calculated factors k, h, f, g. k, h, f, g are positive numbers.

IRQ7 interrupt routine: This interrupt occurs when the first container passes through calibration sensor-1.

SENSOR$1$FACTOR (a) is a positive number. When the system is in power up reset mode, this interrupt routine will occur once only and it must occur before entering the endless loop in the main routine.

To maintain positive factors, the RST55 and IRQ7 routine will call XXX routine.

NOTE
k is VFATR
h is HFATR
f is RJFATR
g is BVFATR
a is S1FATR or SENSOR$1$FACTOR

TRAP interrupt routine: This routine calibrates six pointers of the Container Table. These pointers must be equal. If the pointers are not equal, the routine will send them to the 8088 central processing unit of processor 51 (FIG. 4).

DISCHARGE ROUTINE

There are three utility routines shown in Appendix K for discharge of a container existing from the seamer 17:

RST65 interrupt routine: three steps occur in this routine:

Step 1: Calculates value number and seamer head number.
Step 2: When the sample is enabled, this routine will call UPDATE$CONTAINER$ENTRY routine. Otherwise, it will assign a value number and a seamer head number to the current Container Table entry, and will also call SET$REJECT routine.
Step 3: Interrupt is enabled and returned.

Updated Container Table entry routine: There are two kinds of functions in this routine:

The primary function is to set sample bit.

The auxiliary functions are to assign value number and seamer head number, and to call SET$REJECT routine to set reject bit of the current container table entry.

Setting of sample bit: This routine uses value number or seamer head number, depending on what we are sampling, filler or seamer, to compare with the current sample list entry. If they are matched, this routine will set the sample bit of the current Container Table entry. Otherwise, this routine will do nothing. This process is called the setting of sample bit.

The bit settings are accessed only when the last sample container is set and the first sample container has not yet arrived at the sample station.

SET$REJECT routine: This routine copies an appropriate Reject Table entry into the sample bit of the current Container Table entry.

INSPECTION ROUTINES

There are four routines shown in Appendix L for the Gamma unit stations.

Filling inspection routines

For the Gamma 101 unit:

at point B—RST75 routine: Sets reject table entry if there is a bad Gamma unit data. Sends Gamma unit result to the 8088 CPU.
at point D—RST75 routine: Sets the current Container Table entry if there is a bad Gamma unit data. Sends Gamma unit result to the 8088 CPU.

For the Gamma 102 unit:

at point B—RST75 routine: Compares with the Gamma unit standard table. Sets reject table entry if there is bad Gamma unit data. Sends Gamma unit result in the 8088 CPU.
at point D—RST75 routine: Compares with the Gamma unit standard table. Sets the current Container Table entry if there is a bad Gamma unit data. Sends Gamma unit result to the 8088 CPU.

Leaking inspection routines: This is an interrupt request routine IRQ1. All are the same as Point D of the FILLING INSPECTION ROUTINE except I/O address.

SAMPLE ROUTINE AND REJECT ROUTINE

The sample station routine shown in Appendix M ejects containers only when the sampling flag is on and sample bit is set.

The station routine shown in Appendix N ejects a container only when the reject bit of the current Container Table entry is set.

COMMUNICATION ROUTINES

Four routines are shown in Appendix O.

In the 'LDMAIL' routine when the mailbox is full, the routine loads three data bytes into post office. All the data in the post office are waiting for mailing to the 8088 CPU.

In the 'DTSND' routine when sending flags:

ON—the mailbox contains three data bytes which are waiting for fetching.
OFF—the data mailbox had been fetched by the 8088 CPU.

'IRQ5' routine: This routine is invoked by the 8088 CPU when the 8088 acknowledges the 8085 CPU in the controller for receiving data. Its function is to obtain data from the post office and send it to the mailbox.

'IRQ6' routine: This routine is invoked when the 8088 CPU sends data to the 8085 CPU. This routine fetches ID code from mailbox, then executes an appropriate case.

The cases covered in 'IRQ6' routine are listed as follows:

CASEØØ: do nothing.
CASEØ1: manual reset.
CASEØ2: update sample list.
CASEØ3: sample list update completed.
CASEØ4: manual close infeed gate.
CASEØ5: manual open infeed gate.
CASEØ6: seamer sample all request
CASEØ7: filler sample request.
CASEØ8: seamer sample request.
CASEØ9: manual reject.
CASEØA: debug read.
CASEØB: debug write.
CASEØC: do nothing.
CASEØD: seamer size parameter.
CASEØE: filler size parameter.
CASEØF: filler sample all request.
CASE1Ø: set valve no-container bit.
CASE11: clear valve no-container bit.
CASE12: set seamer head no-container bit.
CASE13: clear seamer head no-container bit.

From the detailed description above it can be seen that the FLMS system is designed as an expandable system. The minimum requirement for the filler line monitoring is:

the FLMS Controller,
the FLMS Processor,
the filler valve sensing module with three sensors,
the container discharge sensing module including sensor,
the Gamma fill height module with one trigger sensor,
a power supply such as a 5 V.D.C. (5 Amp.) and ±15 V.D.C. (2 Amp.),
A print module and printer are also normally supplied.

The system can be expanded by adding the following options:

The switch display board; sampling ejector with sensor, rejector with sensor; additional fill height inspection; infeed control gate and worm feed screw; line analyzer with CRT and keyboard; indication board; and seamer head sensing module.

The enclosure for the FLMS controller, processor, and switch/display board is a 15×15 inch and 9 inch deep stainless steel box.

The above description of embodiments of this invention is intended to be illustrative and not limiting. Other embodiments of this invention will be obvious to those skilled in the art in view of the above disclosure.

We claim:

1. A monitoring and control system for a fluid container filler line having an empty container in-feed conveyor, a multi-valve rotary fill station, a multi-head seamer station to close and seal the then filled containers, a discharge conveyor and a fill height detector for under and overfill detection of liquid within said containers, said monitoring and control system comprising:

(a) first sensor means located for indicating a first valve of a sequence of numbered fill valves in said fill station, a valve counter, and means for resetting said valve counter to 1 each time increment that said first valve passes said first sensor means;

(b) second sensor means located for counting each valve of the sequence to fill valves; a signal from said second sensor means for advancing said valve counter;

(c) controller means responsive to said first and second sensor means and said valve counter for spacially tracking each of said containers through said system and for identifying a particular fill valve for each particular container;

(d) detector means responsive to said controller means and fault signals from said fill height detector for detecting an improperly filled faulty container and the particular numbered valve which filled said faulty container; and (e) means responsive to detection of improperly filled faulty containers for preventing a container on said infeed conveyor from being positioned in said filter station at a numbered valve of said fill station which has been detected as being faulty.

2. The system set forth in claim 1 in which a second fill height detector is downstream of said seamer station along said discharge conveyor and further including a seamer discharge sensor to indicate and signal exit of a container from said seamer station.

3. The system set forth in claim 1 further comprising third sensor means aimed for indicating the first head of a sequence of numbered heads in said seamer station, a head counter, and means for resetting said head counter to 1 each time that said first head passes said third sensor means; and fourth sensor means for counting each head of the sequence of heads, a signal from said fourth sensor means advancing said head counter, and wherein said detection means is operable to detect a faulty container and the particular numbered head which improperly sealed said container.

4. The system as set forth in claim 3 further including means on said discharge conveyor for turning said containers bottom-up to facilitate leaking and detection of low fill height.

5. The system as set forth in claim 3 further including an infeed control gate responsive to said controller means and said detection means for preventing a container on said infeed conveyor from being positioned at a particular head in said seamer station.

6. The system as set forth in claim 1 in which said sensors are proximity sensors.

7. The system as set forth in claim 1 further including sampling means is for periodically sampling a series of containers filled by a prescribed series of numbered fill valves and to eject such series of containers from said discharge conveyor, said sampling means being responsive to said controller means.

8. The system as set forth in claim 1 in which said controller means includes a central processing unit, decoder means and memory means for storing and processing information from said sensor means and said detection means.

9. The system as set forth in claim 1 including calibration means including a calibration sensor aimed at a fill position below said first valve for informing as to the presence or absence of a container at that fill position and for communicating such information to said controller means.

10. The system as set forth in claim 1 including data processing means for monitoring data from said sensors, analyzing the flow of containers and correct filling thereof and for predicting line fill losses attributable to a faulty valve.

11. The system as set forth in claim 10 further including interrupt means for programming sampling or printing-out indicating the condition of said fill line.

12. A monitoring and control system for a fluid container filler line having an empty container in-feed conveyor, a multi-valve fill station, a multi-head seamer station for closing and sealing the then filled containers, a discharge conveyor and a fill height detector for under and overfill detection of liquid within said containers, said monitoring and control system comprising;

(a) sensor means for counting and spacially identifying containers in said fill station;

(b) means for spacially tracking each of said containers through said system and for identifying the particular fill valve which fills each particular container;

(c) means for detecting improperly filled faulty containers;

(d) means for counting the faulty containers;

(e) means for determining the estimated fill line production losses incident to such faulty containers during a production time increment; and (f) decision means for deciding whether a particular fill valve causing a faulty container shall be rendered inoperative.

13. The invention as set forth in claim 12 further including means responsive to said decision means and associated with said in-feed conveyor for preventing any container from being positioned at such faulty fill valve rendered inoperative.

14. The system as set forth in claim 13 in which said means associated with said in-feed conveyor includes a hydraulic-operated mechanical gate adapted to be momentarily imposed in a stream of containers on said in-feed conveyor for preventing a container from being positioned in a position programmed to be filled at a fill valve determined to be made inoperative.

15. The system as set forth in claim 14 including a worm screw for controlling ingress of containers from said in-feed conveyor to said fill station, operation of said mechanical gate being synchronized with said worm screw so that a worm screw segment does not convey its normal container into said faulty valve of said fill station.

16. The system as set forth in claim 12 wherein said sensor means is positioned opposite said multi-valve liquid fill station and comprising a first sensor for detecting the first of the total number of sequential valves in said station to reset a valve counter to 1, and a second sensor for triggering said valve counter when each valve passes such second sensor.

17. The system as set forth in clain 16 in which said sensor means includes a third sensor for detecting the presence or absence of a can at a particular valve position.

18. The system as set forth in claim 12 further including a seamer sensor means for detecting the first of the total number of seamer heads and for triggering a seamer head counter.

19. The system as set forth in claim 18, including means for detecting leaking faulty containers and means for turning said containers upside down prior to detection for leaking.

20. The system as set forth in claim 12 including means juxtaposed to said discharge conveyor for rejecting any faultably filled container.

* * * * *